United States Patent [19]

Maskasky

[11] Patent Number: 4,471,050

[45] **Date of Patent: * Sep. 11, 1984**

[54] SILVER HALIDE EMULSIONS AND PHOTOGRAPHIC ELEMENTS CONTAINING COMPOSITE GRAINS

[75] Inventor: Joe E. Maskasky, Rochester, N.Y.

[73] Assignee: Eastman Kodak Company, Rochester, N.Y.

[ * ] Notice: The portion of the term of this patent subsequent to Mar. 6, 2001 has been disclaimed.

[21] Appl. No.: 480,631

[22] Filed: Mar. 30, 1983

Related U.S. Application Data

[63] Continuation-in-part of Ser. No. 451,367, Dec. 20, 1982.

[51] Int. Cl.[3] ..... G03C 1/02

[52] U.S. Cl. ..... 430/567; 430/569

[58] Field of Search ..... 430/567, 569

[56] References Cited

PUBLICATIONS

Shiozawa, "Electron Microscopic Study on Conversion of Silver Halide I," Bulletin of the Soc. of Photo. Sci. and Tech. of Japan, No. 22, Dec. 1972, pp. 6–13.

*Primary Examiner*—Mary F. Downey

*Attorney, Agent, or Firm*—Carl O. Thomas

[57] ABSTRACT

Radiation-sensitive emulsions and photographic elements incorporating these emulsions are disclosed. In the emulsions silver halide host grains of a face centered cubic rock salt type crystal structure are present. Nonisomorphic silver salt of a really limited epitaxial compatibility is located on and substantially confined to selected sites of the host grains.

27 Claims, 25 Drawing Figures

1 μm

1 μm

1 μm

1 μm

1μm

1 μm

1 μm 1 um

1μm

1 μm

1 μm

1 μm

1 μm

1 μm

1 μm

1 μm

1μm

1 μm

SILVER HALIDE EMULSIONS AND PHOTOGRAPHIC ELEMENTS CONTAINING COMPOSITE GRAINS

This is a continuation-in-part of U.S. Ser. No. 451,367, filed Dec. 20, 1982.

FIELD OF THE INVENTION

The invention relates to silver halide photography and specifically to emulsions and photographic elements containing composite radiation-sensitive grains.

BACKGROUND OF THE INVENTION

Radiation-sensitive emulsions employed in photography are comprised of a dispersing medium, typically gelatin, containing radiation-sensitive microcrystals—known as grains—of silver halide. The radiation-sensitive silver halide grains employed in photographic emulsions are typically comprised of silver chloride, silver bromide, or silver in combination with both chloride and bromide ions, each often incorporating minor amounts of iodide. Iodide is typically present in concentrations of below about 10 mole percent, but can be present in concentrations as high as about 40 mole percent without creating a separate silver iodide phase, depending upon the temperature of grain formation. Silver halide grains of these compositions have isomorphic face centered cubic rock salt type crystal structures, and this is independent of the crystal faces the grains happen to be bounded by—e.g., {100} crystal faces, as is typical of cubic grains, {111} crystal faces, as is typical of octahedral grains, or some combination of these crystal faces.

Though infrequently employed in photographic applications, silver iodide emulsions are known. The most commonly encountered form of silver iodide crystals is the hexagonal wurtzite type, designated $\beta$ phase silver iodide. Silver iodide is also stable at room temperature in a face centered cubic zinc blende type crystalline form, designated $\gamma$ phase silver iodide.

Maskasky U.S. Pat. Nos. 4,094,684 and 4,142,900 and Koitabashi et al U.K. Patent Application No. 2,053,499A teach the use of silver iodide grains as host grains for the epitaxial deposition of silver chloride and silver bromide. Such emulsions advantageously combine the light absorbing capabilities of silver iodide with the latent image forming and processing characteristics of silver chloride and silver bromide to produce useful radiation-sensitive photographic emulsions.

Koitabashi et al European Patent Application No. 0019917 (published Dec. 10, 1980) discloses epitaxially depositing on silver bromoiodide grains containing from 15 to 40 mole percent iodide, silver halide which contains less than 10 mole percent iodide. The unusually high iodide levels in the host grains are necessary to prevent the indiscriminate deposition of the silver halide on the surfaces of the host grains. From the composition of both the host grains and the silver halide deposited thereon, it is apparent that both are comprised of face centered cubic rock salt type crystal structures.

The indiscriminate deposition of silver salts on face centered cubic rock salt type crystal structure silver halide grains has been suggested from time to time in the art. For example, Berriman U.S. Pat. No. 3,367,778 suggests the use of a variety of silver salts to form the core and/or shell of surface fogged core-shell grains. The silver salts are preferably silver halides, but additionally include silver thiocyanate, silver phosphate, silver cyanide, and silver carbonate.

Walters et al U.S. Pat. No. 3,782,960 discloses direct-print silver halide emulsions which can be light developed or processed by conventional developing-out techniques. It is claimed that increased sensitivity and background stability under latensification are achieved by sensitizing silver halide grains, such as converted-halide silver chlorobromide grains, with 0.01 to about 25 mole percent iodide, from about 0.001 to about 1.0 mole percent gold, and an effective quantity of silver thiocyanate. From electron micrographs of emulsion samples prepared according to Walters no evidence has been found of silver thiocyanate being epitaxially located on the silver halide grains or of the silver thiocyanate being confined to selected sites of the grains.

SUMMARY OF THE INVENTION

In one aspect this invention is directed to a silver halide emulsion comprised of a dispersing medium, silver halide host grains of a face centered cubic rock salt type crystal structure, and nonisomorphic silver salt of areally limited epitaxial compatibility located on and substantially confined to selected sites of said host grains.

In another aspect, this invention is directed to a photographic element comprised of a support and at least one layer comprised of a radiation-sensitive emulsion as described above.

The present invention provides sensitization, controlled site latent image formation, controlled development, and other advantages resulting from controlled site epitaxial silver salt deposits on host silver halide grains. Specifically, this invention extends these advantages to silver halide emulsions not heretofore contemplated by the art. It has been discovered that face centered cubic rock salt type crystal structure silver halide host grains are capable of directing the epitaxial deposition of nonisomorphic silver salt to selected sites on the silver halide host grains. Surprisingly, this can be achieved in the absence of any restriction on the crystal faces presented by the silver halide host grains or the halide composition of the host grains forming the face centered cubic rock salt type crystal lattice. Whereas Maskasky U.S. Pat. No. 4,094,684 and No. 4,142,900 and Koitabashi U.K. Patent Application No. 2,053,499A and European Patent Application No. 0019917, cited above, found it necessary to employ iodide in the host grains to deposit silver halides of face centered cubic rock salt type crystal structure at selected sites on the host grains, it has now been discovered that by choosing nonisomorphic crystal lattice silver salts epitaxial deposition at selected sites on face centered cubic rock salt type crystal lattice silver halide host grains can be achieved independent of their iodide content. Maskasky U.S. Ser. No. 431,855, filed Sept. 30, 1982, titled CONTROLLED SITE EPITAXIAL SENSITIZATION, now U.S. Pat. No. 4,435,501, and Maskasky U.S. Ser. No. 451,367, filed Dec. 20, 1982, titled CONTROLLED SITE EPITAXIAL SENSITIZATION OF LIMITED IODIDE SILVER HALIDE EMULSIONS, both commonly assigned, employing host silver halide grains of high aspect ratio tabular configuration and limited iodide content, respectively, teach that silver salt can be epitaxially deposited at selected sites on the host grains by employing an adsorbed site director, such as an adsorbed aggregating spectral sensitizing dye. The present invention does not require the use of either iodide in the host grains or an adsorbed site director to achieve selective site epitaxial deposition of silver salt. Thus, the present invention extends the advantages of selected site silver salt epitaxy to a much broader range of halide emulsions.

DESCRIPTION OF PREFERRED EMBODIMENTS

Figure 1:
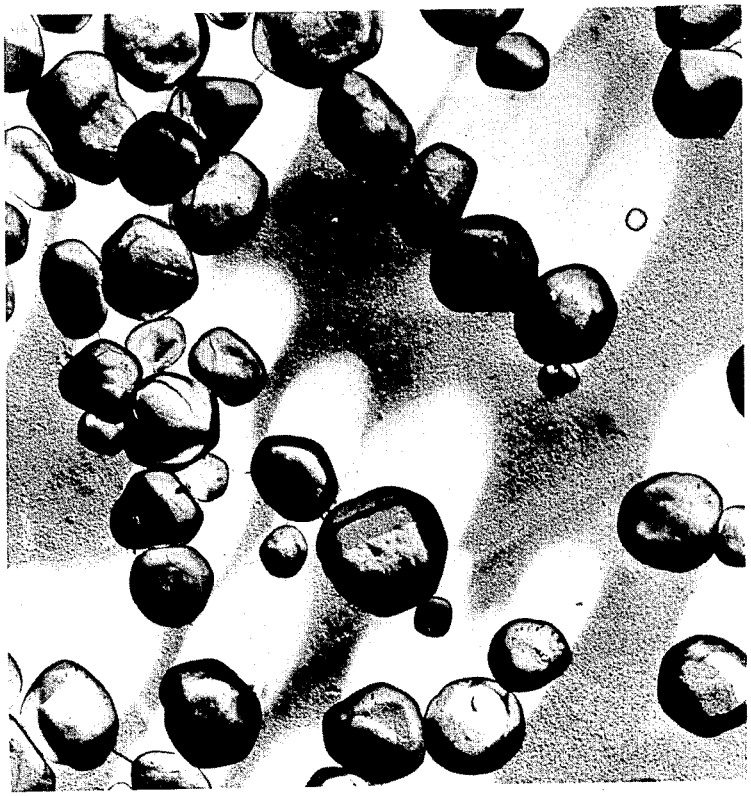
FIGS. 1 through 25 are electron micrographs of emulsion samples.

The present invention is directed to a photographic emulsion comprised of a dispersing medium and radiation-sensitive composite silver halide grains. The composite grains are comprised of silver halide host grains and one or more silver salts epitaxially located on the host grains at selected sites.

The host silver halide grains are of the type commonly employed in silver halide photography. They exhibit isomorphic face centered cubic rock salt type crystal structures. The host grains can be comprised of silver bromide, silver chloride, silver chlorobromide, silver chloroiodide, silver bromoiodide, silver chlorobromoiodide, or mixtures thereof. When iodide is present in the grains, it is limited to that which can be accommodated by the cubic crystal lattice. In a cubic silver bromide crystal lattice up to about 40 mole percent iodide can be incorporated, depending upon the temperature of precipitation. It is specifically contemplated to employ silver halide host grains containing below about 15 mole percent iodide. For ordinary photographic applications iodide concentrations are typically less than about 12 mole percent, and these are particularly preferred. The host grains can include coarse, medium, or fine silver halide grains bounded predominantly by {100} or {111 } crystal planes and can be regular or irregular in shape, including cubic and octahedral shapes, for example. In the cubic and octahedral forms the grains can be tabular grains of high, intermediate, or low aspect ratio.

Typically the host grains are most conveniently prepared as a separate silver halide emulsion prior to the addition of the epitaxially deposited silver salt forming the overall, composite grain structure. The host grain emulsions can be prepared by a variety of techniques—e.g., single-jet, double-jet (including continuous removal techniques), accelerated flow rate, and interrupted precipitation techniques, as illustrated by Trivelli and Smith, *The Photographic Journal,* Vol. LXXIX, May, 1939, pp. 330–338, T.H. James, *The Theory of the Photographic Process,* 4th Ed., Macmillan, 1977, Chapter 3, Nietz et al U.S. Pat. No. 2,222,264, Wilgus German OLS No. 2,107,118, Lewis U.K. Pat. Nos. 1,335,925, 1,430,465, and 1,469,480, Irie et al U.S. Pat. No. 3,650,757, Morgan U.S. Pat. No. 3,917,485, Musliner U.S. Pat. No. 3,790,387, Evans U.S. Pat. No. 3,716,276, Gilman et al U.S. Pat. No. 3,979,213, *Research Disclosure,* Item 17643, Vol. 176, Dec. 1978, and *Research Disclosure,* Item 22534, Vol. 225, Jan. 1983. *Research Disclosure* and its predecessor, *Product Licensing Index,* are publications of Industrial Opportunities Ltd.; Homewell, Havant; Hampshire, P09 lEF, United Kingdom.

Modifying compounds can be present during host grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium, and tellurium), gold, and Group VIII noble metals, can be present during silver halide precipitation, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, Atwell U.S. Pat. 4,269,927, and *Research Disclosure,* Vol. 134, June 1975, Item 13452.

The composite grains are formed by epitaxially depositing onto the host grains a silver salt. The term "epitaxy" and its derivatives are employed in their art recognized sense of denoting that the crystal structure of the silver salt has its orientation controlled by the silver halide grain forming the crystal substrate on which it is grown. It is the recognition of the present invention that by choosing a silver salt which is nonisomorphic in relation to the host grain crystal structure only a limited portion of the surface of the host grain can be sufficiently crystallographically compatible with the silver salt to permit epitaxial deposition of the silver salt to occur. The result is that the silver salt epitaxy can be substantially confined to areally limited epitaxially compatible surface sites of the host grains, hereinafter also referred to as selected surface sites. For example, the silver salt epitaxy is typically substantially confined to the edges and/or corners of the host grains, although other selected site locations are possible. By confining the silver salt epitaxy to the selected sites it is substantially excluded in a controlled manner from most of the surface area of the crystal faces of the host grains.

It is a distinguishing feature of the present invention that the nonisomorphic silver salt is epitaxially deposited on the face centered cubic rock salt type crystal structure of the host grains at selected surface sites independent of the halide composition of the host grains—e.g., independent of any particular iodide concentration in the face centered cubic rock salt type crystal structure of the host grains—and in the absence of an adsorbed site director, such as disclosed in Maskasky U.S. Ser. Nos. 431,855 and 451,367, cited above. The silver salt that is epitaxially deposited onto the host silver halide grains, subject to the considerations noted above, can be generally chosen from among any silver salt known to be useful in photography. The requirement that the silver salt be nonisomorphic with respect to the host silver halide grains precludes the silver salt from taking a face centered cubic rock salt type crystal structure as epitaxially deposited.

Exemplary useful silver salts can take a variety of crystalline forms. Illustrative nonisomorphic silver salts specifically contemplated are silver iodide, silver thiocyanate, silver phosphates, silver cyanide, and silver carbonate.

$\beta$ phase silver iodide is known to be of the hexagonal wurtzite type crystal structure. $\beta$ phase silver iodide emulsions have been precipitated by techniques such as those described, for example, by Steigmann German Pat. No. 505,012, Maskasky U.S. Pat. Nos. 4,094,684 and 4,142,900, Koitabashi et al U.K. Patent Application No. 2,053,499A, Zharkov, Dobroserdova, and Panfilova, "Crystallization of Silver Halides in Photographic Emulsions IV. Study by Electron Microscopy of Silver Iodide Emulsions", *Zh. Nauch. Prikl. Fot. Kine,* March–April, 1957, 2, pp. 102–105, and Byerley and Hirsch, "Dispersions of Metastable High Temperature Cubic Silver Iodide", *Journal of Photographic Science,* Vol. 18, 1970, pp. 53–59.

$\gamma$ phase silver iodide is a specific example of a silver salt known to form grains of a face centered cubic zinc blende type crystal structure. The preparation of $\gamma$ phase silver iodide emulsions is disclosed by Byerley and Hirsch, cited above, by Daubendiek, "AgI Precipitations: Effects of pAg on Crystal Growth (PB)", III-23, *Papers from the* 1978 *International Congress of Photographic Science,* Rochester, New York, pp. 140–143, 1978, and by Maskasky U.S. Ser. No. 451,309, filed Dec. 20, 1982, commonly assigned, each here incorporated by reference.

Silver thiocyanate is more commonly encountered in its $\alpha$ phase crystalline form, but has also been observed in a $\beta$ phase crystalline form, as illustrated by Smith, Maskasky, and Spaulding "Polymorphism in Silver Thiocyanate: Preparation of a New Phase and Its Characterization by X-ray Powder Diffraction", *J. Appl. Cryst.,* 1982, Vol. 15, pp. 488–492. Silver thiocyanate can take orthorhombic and monoclinic crystalline forms. Silver cyanide generally exhibits a hexagonal rhombohedral crystalline form.

Silver phosphates can take a variety of forms, both in composition and crystal structure. As employed herein the term "phosphates" is inclusive of meta-phosphate ($PO_3$), phosphate ($PO_4$), and pyro-phosphate ($P_2O_7$). In varied forms either silver or oxygen atoms can be displaced. For example, silver phosphate can take the form $Ag_2R^1PO_4$, where $R^1$ is a cation, such as hydrogen or a metal ion, or the form $Ag_2R^2PO_3$, where $R^2$ is a ligand, such as an organic ligand, bonded directly to the phosphorus atom. Silver meta-phosphate generally exhibits a monoclinic crystalline form. Silver phosphate ($Ag_3PO_4$) generally exhibits a cubic (H-21) crystalline form.

Silver carbonate, though exhibiting a high solubility, has been suggested for use in photographic emulsions. Silver carbonate generally exhibits a monoclinic crystalline form.

An improvement in sensitivity can be achieved by epitaxial deposition at selected sites on the host grains without the use of additional chemical sensitization. Generally sensitivity is improved by confining the epitaxy to selected sites on the host silver halide grains. The extent to which the silver salt is confined to selected sensitization sites, leaving at least a portion of the host crystal faces substantially free of epitaxially deposited silver salt, can be varied widely without departing from the invention. It is specifically contemplated to confine epitaxially deposited silver salt to less than half the total area of the crystal faces of the host grains, preferably less than 25 percent, and in certain forms optimally to less than 5 or even less than 1 percent of the total surface area of the major crystal faces of the host grains. Thus, where epitaxy is limited, it may be substantially confined to selected corner and/or edge sensitization sites and effectively excluded from the major crystal faces.

Controlled site epitaxy can be achieved over a wide range of epitaxially deposited silver salt concentrations. Incremental sensitivity can be achieved with silver salt concentrations as low as about 0.05 mole percent, based on total silver present in the composite sensitized grains. On the other hand, maximum levels of sensitivity are achieved with silver salt concentrations of less than 50 mole percent. Generally epitaxially deposited silver salt concentrations of from 0.3 to 25 mole percent are preferred, with concentrations of from about 0.5 to 10 mole percent being generally optimum for sensitization. Generally the slower the rate of epitaxial deposition the fewer the sites at which epitaxial deposition occurs. Thus, epitaxial deposition can be, if desired, not only substantially excluded from the major faces the host silver halide grains, but also confined to less than all the edges and corners of the host grains.

It is a specific recognition of this invention that the selective site deposition of a nonisomorphic silver salt onto a silver halide host grain does not require the use of an adsorbed site director. However, it is recognized that more areally restricted siting of nonisomorphic silver salts can be practiced by employing one or more adsorbed site directors, as is taught by Maskasky U.S. Ser. Nos. 431,855 and 451,367, both cited above, and here incorporated by reference.

Depending upon the silver salt chosen and the intended application, the silver salt can usefully be deposited in the presence of any of the modifying compounds described above in connection with the silver halide host grains. Some of the silver halide forming the host grains may enter solution during epitaxial deposition and be incorporated in the silver salt epitaxy. Thus, reference to a particular silver salt as being epitaxially located on a host grain is not intended to exclude the presence of some silver halide of a composition also present in the host grain so long as the nonisomorphic crystalline relationship is maintained during epitaxial deposition.

The epitaxial deposition of more than one silver salt onto a given silver halide host grain is specifically contemplated. Multilevel epitaxy—that is, silver salt epitaxy located on a differing silver salt which is itself epitaxially deposited onto the host grain—is specifically contemplated. It is also possible to grow more than one silver salt directly on the host grain. In the examples below both silver thiocyanate and silver cyanide are grown directly onto host silver halide grains in the absence of an adsorbed site director. Another variation is to epitaxially deposit a nonisomorphic silver salt in the absence of an adsorbed site director at selected sites on the host silver halide grains and then to deposit an isomorphic silver salt, typically another silver halide, in the presence of an adsorbed site director onto remaining selected sites on the host silver halide grains. For example, silver thiocyanate can be grown on the edges of host grains, such as silver bromide or silver bromoiodide grains, in the absence of an adsorbed site director. Thereafter a site director can be adsorbed to the remaining host grain surfaces and another silver halide salt, such as silver chloride, epitaxially grown selectively at the corners of the host grains. It is also contemplated that random site epitaxy can be present in addition to and separate from controlled site epitaxy. For example, following controlled site epitaxy of silver thiocyanate random silver halide epitaxial deposition can be undertaken. It is specifically contemplated to deposit sufficient isomorphic silver halide following controlled site epitaxy of nonisomorphic silver salt to effectively shell the grain, selectively covering only the host silver halide grain or both the nonisomorphic silver salt and the host grain.

Depending upon the composition of the silver salt epitaxy and the silver halide host grains, the silver salt can sensitize either by acting as a hole trap or an electron trap. In the latter instance the silver salt epitaxy also locates the latent image sites formed on imagewise exposure. Modifying compounds can be chosen from among those identified above to be useful in depositing silver halide emulsions.

Since silver salt epitaxy on the host grains can act either as an electron trap or as a hole trap, it is appreciated that silver salt epitaxy acting as a hole trap in combination with silver salt epitaxy acting as an electron trap forms a complementary sensitizing combination. For example, it is specifically contemplated to sensitize host grains selectively with electron trapping silver salt epitaxy as well as hole trapping silver salt epitaxy. A latent image can be formed at the electron trapping epitaxy site while the remaining epitaxy further enhances sensitivity by trapping photogenerated holes that would otherwise be available for annihilation of photogenerated electrons. In a specific illustrative form silver chloride is epitaxially deposited on a silver bromoiodide tabular grain at a central region which contains less than 5 mole percent iodide with the remainder of the major crystal faces containing a higher percentage of iodide. The silver chloride is epitaxially deposited in the presence of a modifying compound favoring electron trapping, such as a compound providing a lead or iridium dopant. Thereafter hole trapping silver salt epitaxy can be selectively deposited at the corners of the host tabular grains or as a ring along the edges of the major crystal faces. For example, silver thiocyanate including a copper dopant can be deposited on the host tabular grains. Other combinations are, of course, possible. For example, the central epitaxy can function as a hole trap while the epitaxy at the corners of the host tabular grains can function as an electron trap when the locations of the modifying materials identified above are exchanged.

Although the epitaxial deposition of silver salt is discussed above with reference to selective site sensitization, it is appreciated that the controlled site epitaxial deposition of silver salt can be useful in other respects. For example, the epitaxially deposited silver salt can improve the incubation stability of the emulsion. It can also be useful in facilitating partial grain development, which is a technique for reducing granularity, and in dye image amplification processing, as is more fully discussed below. The epitaxially deposited silver salt can also relieve dye desensitization. Another advantage that can be realized is improved developability. Also, localized epitaxy can produce higher contrast.

Conventional chemical sensitization can be undertaken prior to controlled site epitaxial deposition of silver salt on the host grain or as a following step. For example, when silver thiocyanate is deposited on silver bromoiodide, a large increase in sensitivity is realized merely by selective site deposition of the silver salt. Thus, further chemical sensitization steps of a conventional type need not be undertaken to obtain photographic speed. On the other hand, an additional increment in speed can generally be obtained when further chemical sensitization is undertaken, and it is a distinct advantage that neither elevated temperature nor extended holding times are required in finishing the emulsion. The quantity of sensitizers can be reduced, if desired, where (1) epitaxial deposition itself improves sensitivity or (2) sensitization is directed to epitaxial deposition sites. Spectral sensitization before, during, or following chemical sensitization is contemplated, but is preferably delayed until after controlled epitaxial deposition of at least one nonisomorphic silver salt.

Any conventional technique for chemical sensitization following controlled site epitaxial deposition can be employed. In general chemical sensitization should be undertaken based on the composition of the silver salt deposited rather than the composition of the host grains, since chemical sensitization is generally believed to occur primarily at the silver salt deposition sites or perhaps immediately adjacent thereto.

The silver halide emulsions of the present invention can be chemically sensitized before or after epitaxial deposition with active gelatin, as illustrated by T. H. James, *The Theory of the Photographic Process*, 4th Ed., Macmillan, 1977, pp. 67–76, or with sulfur, selenium, tellurium, gold, platinum, palladium, iridium, osmium, rhodium, rhenium, or phosphorus sensitizers or combinations of these sensitizers, such as at pAg levels of from 5 to 10, pH levels of from 5 to 8 and temperatures of from 30 to 80° C., as illustrated by *Research Disclosure*, Vol. 120, April 1974, Item 12008, *Research Disclosure*, Vol. 134, June 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Pat. No. 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Pat. No. 1,396,696; chemical sensitization being optionally conducted in the presence of thiocyanate compounds, preferably in concentrations of from $2\times10^{-3}$ to 2 mole percent, based on silver, as described in Damschroder U.S. Pat. No. 2,642,361; sulfur containing compounds of the type disclosed in Lowe et al U.S. Pat. No. 2,521,926, Williams et al U.S. Pat. No. 3,021,215, and Bigelow U.S. Pat. No. 4,054,457. It is specifically contemplated to sensitize chemically in the presence of finish (chemical sensitization) modifiers—that is, compounds known to suppress fog and increase speed when present during chemical sensitization, such as azaindenes, azapyridazines, azapyrimidines, benzothiazolium salts, and sensitizers having one or more heterocyclic nuclei. Exemplary finish modifiers are described in Brooker et al U.S. Pat. No. 2,131,038, Dostes U.S. Pat. No. 3,411,914, Kuwabara et al U.S. Pat. No. 3,554,757, Oguchi et al U.S. Pat. No. 3,565,631, Oftedahl U.S. Pat. No. 3,901,714, Walworth Canadian Pat. No. 778,723, and Duffin Photographic Emulsion Chemistry, Focal Press (1966), New York, pp. 138–143. Additionally or alternatively, the emulsions can be reduction sensitized—e.g., with hydrogen, as illustrated by Janusonis U.S. Pat. No. 3,891,446 and Babcock et al U.S. Pat. No. 3,984,249, by low pAg (e.g., less than 5) and/or high pH (e.g., greater than 8) treatment or through the use of reducing agents, such as stannous chloride, thiourea dioxide, polyamines and amineboranes, as illustrated by Allen et al U.S. Pat. No. 2,983,609, Oftedahl et al *Research Disclosure*, Vol. 136, Aug. 1975, Item 13654, Lowe et al U.S. Pat. No. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564. Surface chemical sensitization, including sub-surface sensitization, illustrated by Morgan U.S. Pat. No. 3,917,485 and Becker U.S. Pat. No. 3,966,476, is specifically contemplated.

In addition to being chemically sensitized the silver halide emulsions of the present invention are preferably also spectrally sensitized. It is specifically contemplated to employ spectral sensitizing dyes that exhibit absorption maxima in the blue and minus blue—i.e., green and red, portions of the visible spectrum. In addition, for specialized applications, spectral sensitizing dyes can be employed which improve spectral response beyond the visible spectrum. For example, the use of infrared absorbing spectral sensitizers is specifically contemplated.

The silver halide emulsions of this invention can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium, and imidazopyrazinium quaternary salts.

The merocyanine spectral sensitizing dyes include, joined by a double bond or methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering*, Vol. 18, 1974, pp. 418–430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al U.S. Pat. No. 2,131,038 and Shiba et al U.S. Pat. No. 3,930,860.

In certain varied forms of this invention, as where the controlled site epitaxial deposition of a silver salt which is isomorphoric in relation to the host silver halide grain is undertaken following the controlled site epitaxial deposition of a nonisomorphic silver salt, the spectral sensitizing dyes can be chosen to also function as adsorbed site directors during isomorphic silver salt deposition. Useful dyes of this type are aggregating dyes. Such dyes exhibit a bathochromic or hypsochromic increase in light absorption as a function of adsorption on silver halide grains surfaces. Dyes satisfying such criteria are well known in the art, as illustrated by T. H. James, *The Theory of the Photographic Process*, 4th Ed., Macmillan, 1977, Chapter 8 (particularly, F. Induced Color Shifts in Cyanine and Merocyanine Dyes) and Chapter 9 (particularly, H. Relations Between Dye Structure and Surface Aggregation) and F. M. Hamer, *Cyanine Dyes and Related Compounds*, John Wiley and Sons, 1964, Chapter XVII (particularly, F. Polymerization and Sensitization of the Second Type). Merocyanine, hemicyanine, styryl, and oxonol spectral sensitizing dyes which produce H aggregates (hypsochromic shifting) are known to the art, although J aggregates (bathochromic shifting) are not common for dyes of these classes. Preferred spectral sensitizing dyes are cyanine dyes which exhibit either H or J aggregation.

In a specifically preferred form the spectral sensitizing dyes are carbocyanine dyes which exhibit J aggregation. Such dyes are characterized by two or more basic heterocyclic nuclei joined by a linkage of three methine groups. The heterocyclic nuclei preferably include fused benzene rings to enhance J aggregation. Preferred heterocyclic nuclei for promoting J aggregation are quinolinium, benzoxazolium, benzothiazolium, benzoselenazolium, benzimidazolium, naphthooxazolium, naphthothiazolium, and naphthoselenazolium quaternary salts.

Specific preferred dyes for use as adsorbed site directors in accordance with this invention are illustrated by the dyes listed below in Table I.

TABLE I

| Illustrative Preferred Adsorbed Site Directors | |
|---|---|
| AD-1 | Anhydro-9-ethyl-3,3'-bis(3-sulfopropyl)-4,5,4',5'-dibenzothiacarbocyanine hydroxide, |
| AD-2 | Anhydro-5,5'-dichloro-9-ethyl-3,3'-bis(3-sulfobutyl)thiacarbocyanine hydroxide |
| AD-3 | Anhydro-5,5',6,6'-tetrachloro-1,1'-diethyl-3,3'-bis(3-sulfobutyl)benzimidazolocarbocyanine hydroxide |
| AD-4 | Anhydro-5,5',6,6'-tetrachloro-1,1',3-triethyl-3'-(3-sulfobutyl)benzimidazolocarbocyanine hydroxide |
| AD-5 | Anhydro-5-chloro-3,9-diethyl-5'-phenyl-3'-(3-sulfopropyl)oxacarbocyanine hydroxide |
| AD-6 | Anhydro-5-chloro-3',9-diethyl-5'-phenyl-3-(3-sulfopropyl)oxacarbocyanine hydroxide |
| AD-7 | Anhydro-5-chloro-9-ethyl-5'-phenyl-3,3'-bis(3-sulfopropyl)oxacarbocyanine hydroxide |
| AD-8 | Anhydro-9-ethyl-5,5'-diphenyl-3,3'-bis(3-sulfobutyl)oxacarbocyanine hydroxide |
| AD-9 | Anhydro-5,5'-dichloro-3,3'-bis(3-sulfopropyl)thiacyanine hydroxide |
| AD-10 | 1,1'-Diethyl-2,2'-cyanine p-toluenesulfonate |

Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering,* Vol. 18, 1974, pp. 49–53 (Sturmer et al), pp. 175–178 (Leubner) and pp. 475–485 (Gilman). Oxidation and reduction potentials can be measured as described by R. J. Cox, *Photographic Sensitivity,* Academic Press, 1973, Chapter 15.

The chemistry of cyanine and related dyes is illustrated by Weissberger and Taylor, *Special Topics of Heterocyclic Chemistry,* John Wiley and Sons, New York, 1977, Chapter VIII; Venkataraman, *The Chemistry of Synthetic Dyes,* Academic Press, New York, 1971, Chapter V; James, *The Theory of the Photographic Process,* 4th Ed., Macmillan, 1977, Chapter 8, and F. M. Hamer, *Cyanine Dyes and Related Compounds,* John Wiley and Sons, 1964.

Although native blue sensitivity of silver bromide or bromoiodide is usually relied upon in the art in emulsion layers intended to record exposure to blue light, significant advantages can be obtained by the use of spectral sensitizers, even where their principal absorption is in the spectral region to which the emulsions possess native sensitivity. For example, it is specifically recognized that advantages can be realized from the use of blue spectral sensitizing dyes. When the emulsions of the invention are high aspect ratio tabular grain silver bromide and silver bromoiodide emulsions, very large increases in speed are realized by the use of blue spectral sensitizing dyes.

Among useful spectral sensitizing dyes for sensitizing silver halide emulsions are those found in U.K. Pat. No. 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,231,658, 2,493,747, '748, 2,526,632, 2,739,964 (U.S. Pat. No. Re. 24,292), 2,778,823, 2,917,516, 3,352,857, 3,411,916 and 3,431,111, Wilmanns et al U.S. Pat. No. 2,295,276, Sprague U.S. Pat. Nos. 2,481,698 and 2,503,776, Carroll et al U.S. Pat. Nos. 2,688,545 and 2,704,714, Larive et al U.S. Pat. Nos. 2,921,067, Jones U.S. Pat. No. 2,945,763, Nys et al U.S. Pat. No. 3,282,933, Schwan et al U.S. Pat. No. 3,397,060, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349. Examples of useful dye combinations, including supersensitizing dye combinations, are found in Motter U.S. Pat. No. 3,506,443 and Schwan et al U.S. Pat. No. 3,672,898. As examples of supersensitizing combinations of spectral sensitizing dyes and non-light absorbing addenda, it is specifically contemplated to employ thiocyanates during spectral sensitization, as taught by Leermakers U.S. Pat. No. 2,221,805; bis-triazinylaminostilbenes, as taught by McFall et al U.S. Pat. No. 2,933,390; sulfonated aromatic compounds, as taught by Jones et al U.S. Pat. No. 2,937,089; mercapto-substituted heterocycles, as taught by Riester U.S. Pat. No. 3,457,078; iodide, as taught by U.K. Pat. No. 1,413,826; and still other compounds, such as those disclosed by Gilman, "Review of the Mechanisms of Supersensitization", cited above.

It is known in the photographic art that optimum spectral sensitization is obtained with organic dyes at about 25 percent to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.,* Vol 56, p. 1065, 1952, and Spence et al, "Desensitization of Sensitizing Dyes", *Journal of Physical and Colloid Chemistry,* Vol. 56, No. 6, June 1948, pp. 1090–1103; and Gilman et al U.S. Pat. No. 3,979,213. Optimum dye concentration levels can be chosen by procedures taught by Mees, *Theory of the Photographic Process,* Macmillan, 1942, pp. 1067–1069. It is preferred to adsorb spectral sensitizing dye to the grain surfaces of the high aspect ratio tabular grain emulsions in a substantially optimum amount—that is, in an amount sufficient to realize at least 60 percent of the maximum photographic speed attainable from the grains under contemplated conditions of exposure.

Although not required to realize all of their advantages, the emulsions of the present invention are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 (1 − log E), where E is measured in meter-candle-seconds at a density of 0.1 above fog.

Once emulsions have been generated by precipitation procedures, washed, and sensitized, as described above, their preparation can be completed by the incorporation of conventional photographic addenda, and they can be usefully applied to photographic applications requiring a silver image to be produced—e.g., conventional black-and-white photography.

The photographic elements of this invention are preferably forehardened as described in *Research Disclosure,* Vol. 176, December 1978, Item 17643, Paragraph X, here incorporated by reference. Although hardening of the photographic elements intended to form silver images to the extent that hardeners need not be incorporated in processing solutions is specifically preferred, it is recognized that the emulsions of the present invention can be hardened to any conventional level. It is further specifically contemplated to incorporate hardeners in processing solutions, as illustrated, for example, by *Research Disclosure,* Vol. 184, August 1979, Item 18431, Paragraph K, relating particularly to the processing of radiographic materials.

The present invention is equally applicable to photographic elements intended to form negative or positive images. For example, the photographic elements can be of a type which form either surface or internal latent images on exposure and which produce negative images on processing. Alternatively, the photographic elements can be of a type that produce direct positive images in response to a single development step. When the composite grains comprised of the host grain and the silver salt epitaxy form an internal latent image, surface fogging of the composite grains can be undertaken to facilitate the formation of a direct positive image. In a specifically preferred form the silver salt epitaxy is chosen to itself form an internal latent image site (i.e., to internally trap electrons) and surface fogging can, if desired, be limited to just the silver salt epitaxy. In another form the host grain can trap electrons internally with the silver salt epitaxy preferably acting as a hole trap. The surface fogged emulsions can be employed in combination with an organic electron acceptor as taught, for example, by Kendall et al U.S. Pat. 2,541,472, Shouwenaars U.K. Pat. No. 723,019, Illingsworth U.S. Pat. Nos. 3,501,305, '306, and '307, *Research Disclosure,* Vol, 134, June, 1975, Item 13452, Kurz U.S. Patent 3,672,900, Judd et al U.S. Pat. No. 3,600,180, and Taber et al U.S. Pat. 3,647,643. The organic electron acceptor can be employed in combination with a spectrally sensitizing dye or can itself be a spectrally sensitizing dye, as illustrated by Illingsworth et al U.S. Pat. 3,501,310. If internally sensitive emulsions are employed, surface fogging and organic electron acceptors can be employed in combination as illustrated by Lincoln et al U.S. Pat. 3,501,311, but neither surface fogging nor organic electron acceptors are required to produce direct positive images.

In addition to the specific features described above, the photographic elements of this invention can employ conventional features, such as disclosed in *Research Disclosure,* Item 17643, cited above and here incorporated by reference. Optical brighteners can be introduced, as disclosed at Paragraph V. Antifoggants and stabilizers can be incorporated, as disclosed at Paragraph VI. Absorbing and scattering materials can be employed in the emulsions of the invention and in separate layers of the photographic elements, as described in Paragraph VIII. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. When the photographic elements of the invention are intended to serve radiographic applications, emulsion and other layers of the radiographic element can take any of the forms specifically described in *Research Disclosure,* Item 18431, cited above, here incorporated by reference. The emulsions of the invention, as well as other, conventional silver halide emulsion layers, interlayers, overcoats, and subbing layers, if any, present in the photographic elements can be coated and dried as described in Item 17643, Paragraph XV.

In accordance with established practices within the art it is specifically contemplated to blend the emulsions of the present invention with each other or with conventional emulsions to satisfy specific emulsion layer requirements. For example, it is known to blend emulsions to adjust the characteristic curve of a photographic element to satisfy a predetermined aim. Blending can be employed to increase or decrease maximum densities realized on exposure and processing, to decrease or increase minimum density, and to adjust characteristic curve shape intermediate its toe and shoulder. To accomplish this the emulsions of this invention can be blended with conventional silver halide emulsions, such as those described in Item 17643, cited above, Paragraph I. It is specifically contemplated to blend the emulsions as described in sub-paragraph F of Paragraph I.

In their simplest form photographic elements according to the present invention employ a single silver halide emulsion layer containing an emulsion according to the present invention and a photographic support. It is, of course, recognized that more than one silver halide emulsion layer as well as overcoat, subbing, and interlayers can be usefully included. Instead of blending emulsions as described above the same effect can usually be achieved by coating the emulsions to be blended as separate layers. Coating of separate emulsion layers to achieve exposure latitude is well known in the art, as illustrated by Zelikman and Levi, *Making and Coating Photographic Emulsions,* Focal Press, 1964, pp. 234–238; Wyckoff U.S. Pat. No. 3,663,228; and U.K. Pat. No. 923,045. It is further well known in the art that increased photographic speed can be realized when faster and slower silver halide emulsions are coated in separate layers as opposed to blending. Typically the faster emulsion layer is coated to lie nearer the exposing radiation source than the slower emulsion layer. This approach can be extended to three or more superimposed emulsion layers. Such layer arrangements are specifically contemplated in the practice of this invention.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimensional, abrasive, hardness, frictional, antihalation and/or other properties of the support surface. Typical of useful paper and polymeric film supports are those disclosed in *Research Disclosure,* Item 17643, cited above, Paragraph XVII.

Although the emulsion layer or layers are typically coated as continuous layers on supports having opposed planar major surfaces, this need not be the case. The emulsion layers can be coated as laterally displaced layer segments on a planar support surface. When the emulsion layer or layers are segmented, it is preferred to employ a microcellular support. Useful microcellular supports are disclosed by Whitmore Patent Cooperation Treaty published application No. W080/01614, published Aug. 7, 1980, (Belgian Pat. No. 881,513, Aug. 1, 1980, corresponding), Blazey et al U.S. Pat. No. 4,307,165, and Gilmour et al U.S. Pat. No. 4,411,973, here incorporated by reference. Microcells can range from 1 to 200 microns in width and up to 1000 microns in depth. It is generally preferred that the microcells be at least 4 microns in width and less than 200 microns in depth, with optimum dimensions being about 10 to 100 microns in width and depth for ordinary black-and-white imaging applications—particularly where the photographic image is intended to be enlarged.

The photographic elements of the present invention can be imagewise exposed in any conventional manner. Attention is directed to *Research Disclosure* Item 17643, cited above, Paragraph XVIII, here incorporated by reference. The present invention is particularly advantageous when imagewise exposure is undertaken with electromagnetic radiation within the region of the spectrum in which the spectral sensitizers present exhibit absorption maxima. When the photographic elements are intended to record blue, green, red, or infrared exposures, spectral sensitizer absorbing in the blue, green, red, or infrared portion of the spectrum is present. For black-and-white imaging applications it is preferred that the photographic elements be orthochromatically or panchromatically sensitized to permit light to extend sensitivity within the visible spectrum. Radiant energy employed for exposure can be either noncoherent (random phase) or coherent (in phase), produced by lasers. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process*, 4th Ed., Macmillan, 1977, Chapters 4, 6, 17, 18, and 23.

The light-sensitive silver halide contained in the photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry*, Focal Press, London, 1966; *Processing Chemicals and Formulas*, Publication J-1, Eastman Kodak Company, 1973; *Photo-Lab Index*, Morgan and Morgan, Inc., Dobbs Ferry, N.Y., 1977, and *Neblette's Handbook of Photography and Reprography—Materials, Processes and Systems*, VanNostrand Reinhold Company, 7th Ed., 1977.

Included among the processing methods are web processing, as illustrated by Tregillus et al U.S. Pat. No. 3,179,517; stabilization processing, as illustrated by Herz et al U.S. Pat. No. 3,220,839, Cole U.S. Pat. No. 3,615,511, Shipton et al U.K. Pat. No. 1,258,906 and Haist et al U.S. Pat. No. 3,647,453; monobath processing as described in Haist, *Monobath Manual*, Morgan and Morgan, Inc., 1966, Schuler U.S. Pat. No. 3,240,603, Haist et al U.S. Pat. Nos. 3,615,513 and 3,628,955 and Price U.S. Pat. No. 3,723,126; infectious development, as illustrated by Milton U.S. Pat. Nos. 3,294,537, 3,600,174, 3,615,519 and 3,615,524, Whiteley U.S. Pat. No. 3,516,830, Drago U.S. Pat. No. 3,615,488, Salesin et al U.S. Pat. No. 3,625,689, Illingsworth U.S. Pat. No. 3,632,340, Salesin U.K. Pat. No. 1,273,030 and U.S. Pat. No. 3,708,303; hardening development, as illustrated by Allen et al U.S. Pat. No. 3,232,761; roller transport processing, as illustrated by Russell et al U.S. Pat. Nos. 3,025,779 and 3,515,556, Masseth U.S. Pat. No. 3,573,914, Taber et al U.S. Pat. No. 3,647,459 and Rees et al U.K. Pat. No. 1,269,268; alkaline vapor processing, as illustrated by *Product Licensing Index*, Vol. 97, May 1972, Item 9711, Goffe et al U.S. Pat. No. 3,816,136 and King U.S. Pat. No. 3,985,564; metal ion development as illustrated by Price, *Photographic Science and Engineering*, Vol. 19, Number 5, 1975, pp. 283–287 and Vought *Research Disclosure*, Vol. 150, October 1976, Item 15034; reversal processing, as illustrated by Henn et al U.S. Pat. No. 3,576,633; and surface application processing, as illustrated by Kitze U.S. Pat. No. 3,418,132.

Once a silver image has been formed in the photographic element, it is conventional practice to fix the undeveloped silver halide. The high aspect ratio tabular grain emulsions are particularly advantageous in allowing fixing to be accomplished in a shorter time period. This allows processing to be accelerated.

The photographic elements and the techniques described above for producing silver images can be readily adapted to provide a colored image through the selective destruction, formation, or physical removal of dyes, such as described in *Research Disclosure*, Item 17643, cited above, Paragraph VII, Color materials. Processing of such photographic elements can take any convenient form, such as described in Paragraph XIX, Processing.

The present invention can be employed to produce multicolor photographic images merely by adding or substituting an emulsion according to the present invention. The present invention is fully applicable to both additive multicolor imaging and subtractive multicolor imaging.

To illustrate the application of this invention to additive multicolor imaging, a filter array containing interlaid blue, green, and red filter elements can be employed in combination with a photographic element according to the present invention capable of producing a silver image. An emulsion of the present invention which is panchromatically sensitized and which forms a layer of the photographic element is imagewise exposed through the additive primary filter array. After processing to produce a silver image and viewing through the filter array, a multicolor image is seen. Such images are best viewed by projection. Hence both the photographic element and the filter array both have or share in common a transparent support.

Significant advantages can be realized by the application of this invention to multicolor photographic elements which produce multicolor images from combinations of subtractive primary imaging dyes. Such photographic elements are comprised of a support and typically at least a triad of superimposed silver halide emulsion layers for separately recording blue, green, and red exposures as yellow, magenta, and cyan dye images, respectively. Although only one radiation-sensitive emulsion according to the present invention is required, the multicolor photographic element contains at least three separate emulsions for recording blue, green, and red light, respectively. The emulsions other than the required emulsion according to the present invention can be of any convenient conventional form. Various conventional emulsions are illustrated by *Research Disclosure*, Item 17643, cited above, Paragraph I, Emulsion preparation and types, here incorporated by reference. In a preferred form of the invention all of the emulsion layers contain silver bromide or bromoiodide host grains. In a particularly preferred form of the invention at least one green recording emulsion layer and at least one red recording emulsion layer is comprised of an emulsion according to this invention. It is, of course, recognized that all of the blue, green, and red recording emulsion layers of the photographic element can advantageously be emulsions according to the present invention, if desired, although this is not required for the practice of this invention.

Multicolor photographic elements are often described in terms of color-forming layer units. Most commonly multicolor photographic elements contain three superimposed color-forming layer units each containing at least one silver halide emulsion layer capable of recording exposure to a different third of the spectrum and capable of producing a complementary subtractive primary dye image. Thus, blue, green, and red recording color-forming layer units are used to produce yellow, magenta, and cyan dye images, respectively. Dye imaging materials need not be present in any color-forming layer unit, but can be entirely supplied from processing solutions. When dye imaging materials are incorporated in the photographic element, they can be located in an emulsion layer or in a layer located to receive oxidized developing or electron transfer agent from an adjacent emulsion layer of the same color-forming layer unit.

To prevent migration of oxidized developing or electron transfer agents between color-forming layer units with resultant color degradation, it is common practice to employ scavengers. The scavengers can be located in the emulsion layers themselves, as taught by Yutzy et al U.S. Pat. No. 2,937,086 and/or in interlayers between adjacent color-forming layer units, as illustrated by Weissberger et al U.S. Pat. No. 2,336,327.

Although each color-forming layer unit can contain a single emulsion layer, two, three, or more emulsion layers differing in photographic speed are often incorporated in a single color-forming layer unit. Where the desired layer order arrangement does not permit multiple emulsion layers differing in speed to occur in a single color-forming layer unit, it is common practice to provide multiple (usually two or three) blue, green, and/or red recording color-forming layer units in a single photographic element.

The multicolor photographic elements of this invention can take any convenient form consistent with the requirements indicated above. Any of the six possible layer arrangements of Table 27a, p. 211, disclosed by Gorokhovskii, *Spectral Studies of the Photographic Process,* Focal Press, New York, can be employed. It is most common for multicolor photographic elements to locate a blue recording yellow dye image providing color forming layer unit nearest the exposing radiation source followed by a green recording magenta dye image providing color providing layer unit and a red recording cyan dye image providing color providing layer unit in that order. Where both faster and slower red and green recording layer units are present, variant layer order arrangements can be beneficial, as taught by Eeles et al U.S. Pat. No. 4,184,876, Ranz et al German OLS No. 2,704,797, and Lohmann et al German OLS Nos. 2,622,923, 2,622,924, and 2,704,826.

By employing silver halide emulsions of limited iodide content according to the present invention for recording green or red light exposures in multicolor photographic elements significant advantages are realized as compared to the use o.f silver bromoiodide emulsions containing higher levels of iodide, as required by Koitabashi et al, cited above, for example. By increasing the level of iodide in the emulsions the native sensitivity of the emulsions to blue light is increased, and the risk of color falsification in recording green or red exposures is thereby increased. In constructing muilticolor photographic elements color falsification can be analyzed as two distinct concerns. The first concern is the difference between the blue speed of the green or red recording emulsion layer and its green or red speed. The second concern is the difference between the blue speed of each blue recording emulsion layer and the blue speed of the corresponding green or red recording emulsion layer. Generally in preparing a multicolor photographic element intended to record accurately image colors under daylight exposure conditions (e.g., 5500° K.) the aim is to achieve a difference of about an order of magnitude between the blue speed of each blue recording emulsion layer and the blue speed of the corresponding green or red recording emulsion layer. The present invention offers a distinct advantage over Koitabashi et al in achieving such aim speed separations.

EXAMPLES

The invention is further illustrated by the following examples. In each of the examples the contents of the reaction vessel were stirred vigorously throughout the silver and halide salt introductions; the term "percent" means percent by weight, unless otherwise indicated; and the term "M" stands for a molar concentration, unless otherwise stated. All solutions, unless otherwise stated, are aqueous solutions.

COMPARATIVE EXAMPLE

This example was prepared according to Walters et al U.S. Pat. No. 3,782,960, to provide the optimum sensitometric response shown in Table I of the patent.

Emulsion A: Halide Converted Host Emulsion as Described in Col. 4 of the Patent To 2 L of a 1 percent solution of deionized bone gelatin at 71° C., which was 1.05 M in NaCl, was added with stirring, over a period of 10 minutes, 1.0 L of a 2 M solution of $AgNO_3$. The resulting mixture was stirred for an additional 30 minutes at 71° C. Then 1.0 L of a 2.40 M solution of KBr was added over a period of about 30 seconds with stirring. The emulsion was stirred for 10 minutes at 71° C. Following this, 40 g of phthalated gelatin was added and the emulsion coagulation washed according to the procedure of Yutzy and Russell U.S. Pat. No. 2,614,929, which is considered equivalent to the alternative shredding and washing procedure. Following coagulation washing an additional 10 g of deionized bone gelatin was added, and the emulsion was made up to 1.059 Kg/Ag mole with water. A carbon replica electron micrograph is shown in FIG. 1.

Figure 2:
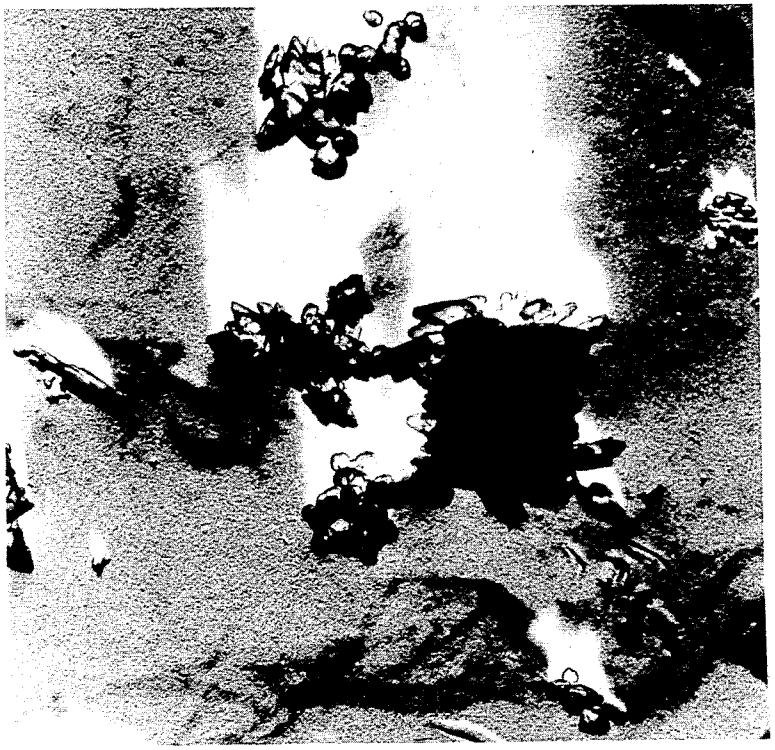

Emulsion B: Silver Thiocyanate Suspension as Described in Col. 3 of the Patent To 500 ml of a 2 percent deionized bone gelatin solution at 40° C. which was 1.2 M in NaSCN was added with stirring 500 ml of a 1.20 M solution of $AgNO_3$ over a period of 19 seconds. An electron micrograph of the resulting AgSCN suspension is shown in FIG. 2.

Figure 3:
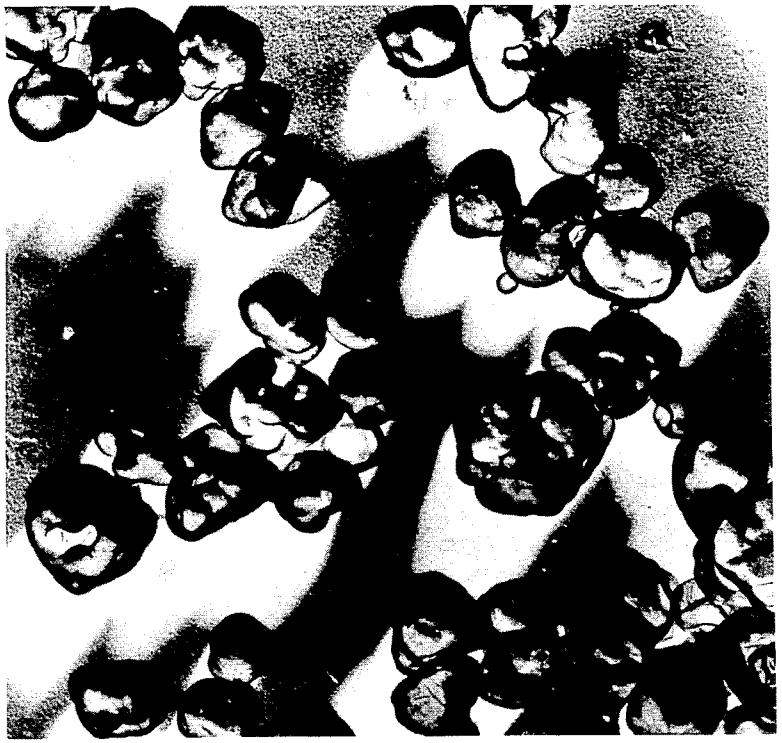

Emulsion C: Host Emulsion Treated with 5.6 Mole Percent Iodide and 8.0 Mole Percent AgSCN as Described in Example IV of the Patent To 84.8 g of Emulsion A (0.08 Ag mole) at 40° C. was slowly added with stirring 2.0 ml (5.6 mole percent) of a 33.6 percent solution of NaI. Then 10.6 ml (8.0 mole percent) of the AgSCN suspension, Emulsion B was added. The mixture was heated for 10 minutes at 71° C. FIG. 3 is an electron micrograph of the resulting emulsion grains. No discrete epitaxial growth is discernible.

Emulsion D: Octahedral AgBr Emulsion Treated with Iodide and AgSCN

Figure 4:
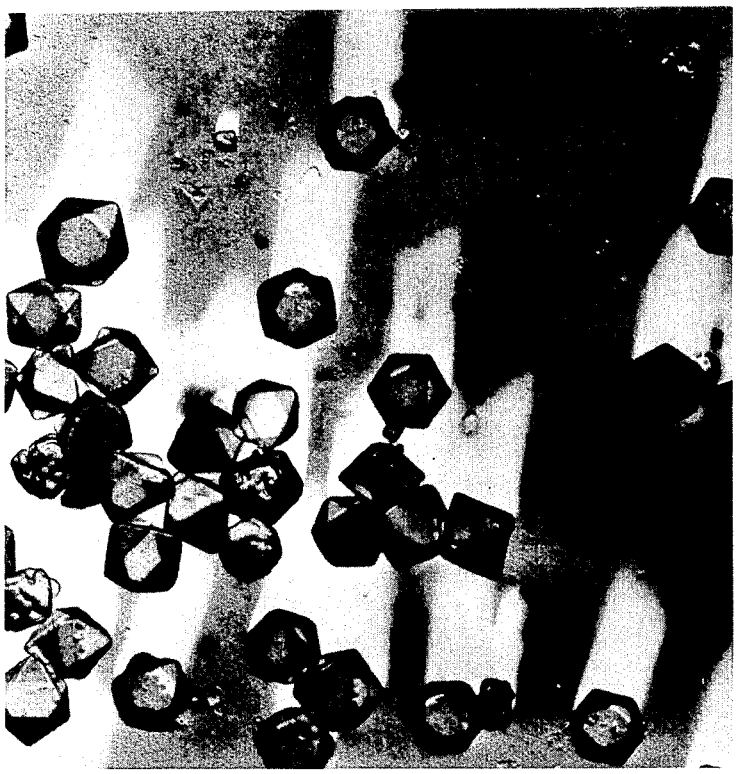

A sample of an 0.8 μm octahedral AgBr emulsion was treated with 5.6 mole percent of NaI and 8.0 mole percent of AgSCN using the same procedure as for Emulsion C. FIG. 4 is an electron micrograph showing the resulting emulsion grains. No discrete, ordered epitaxy is visible.

COMPARATIVE EXAMPLE COATINGS

The following coatings of Emulsion A and C were made on cellulose acetate support at 3 g Ag/m$^2$. Deionized gelatin was added to the emulsion samples in an amount of 108 g/Ag mole, and sufficient NaBr to provide 15 mole percent of bromide, as described in U.S. Pat. No. 3,782,760, Col. 4. The coatings were exposed for 100 microseconds to a xenon sensitometer through a step tablet and latensified as described in Col. 4 of the Patent.

Coating 1: Halide Converted Host Emulsion

A coating of Emulsion A.

Coating 2: Host Emulsion Treated with Iodide and AgSCN

A coating of Emulsion C.

COMPARATIVE EXAMPLE

COATING RESULTS

| Coating No. | Image | Dmin | Dmax | ΔD |
|---|---|---|---|---|
| 1 | No | — | — | — |
| 2 | Yes | 0.59 | 0.72 | 0.13 |

Image discrimination was shown only by Emulsion C. The correspondence of photographic performance to that reported by Walters et al corroborates that the silver halide emulsions prepared by Walters et al did not exhibit selected site epitaxially deposited silver thiocyanate. FIGS. 3 and 4 should be further compared with the subsequent figures showing epitaxy satisfying the requirements of this invention.

EXAMPLE 1

Example 1 illustrates edge-selective epitaxial deposition of 10 mole percent silver thiocyanate onto an octahedral AgBr emulsion.

Emulsion 1A: Host Octahedral Silver Bromide Emulsions

Figure 5:
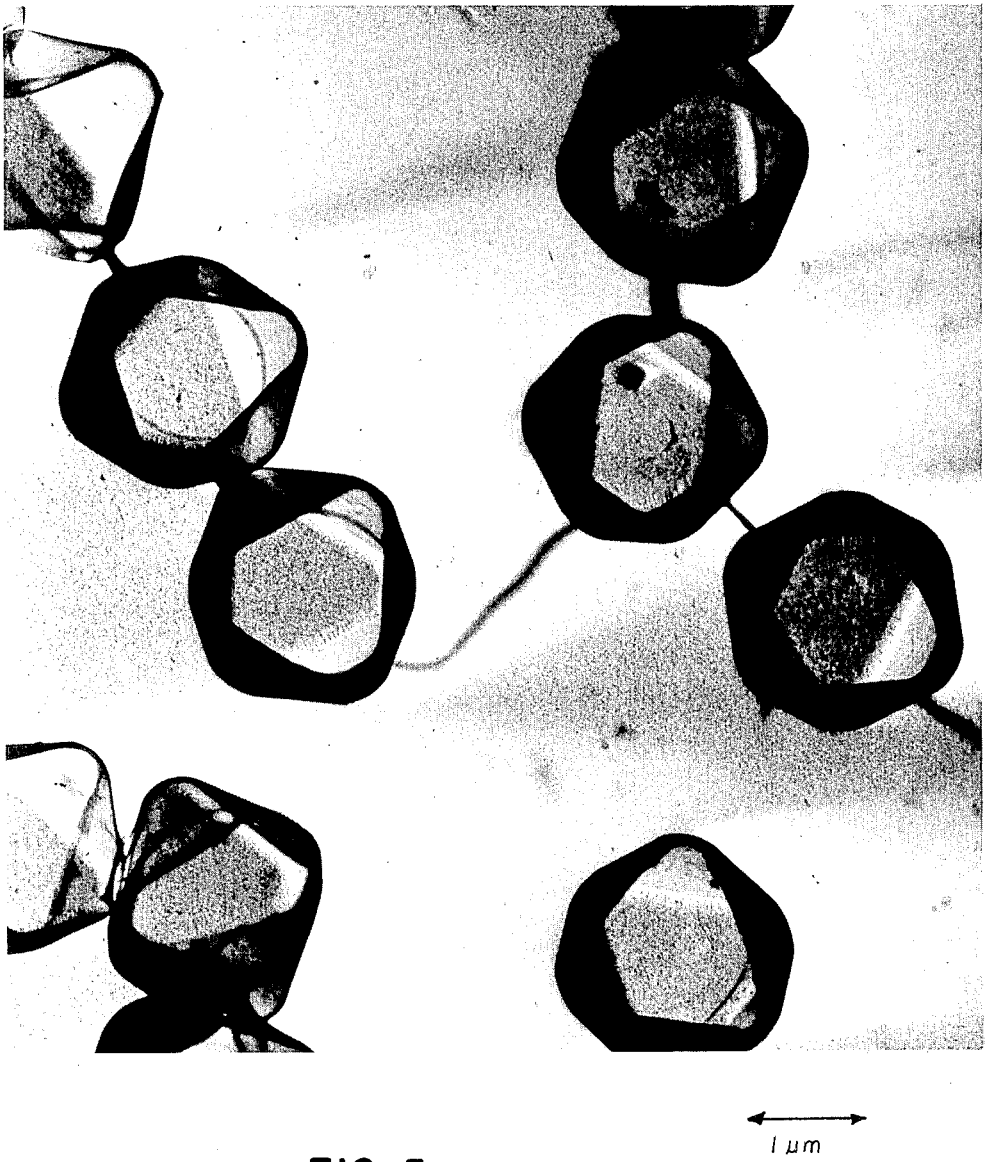

The host emulsion for Example 5 was a monodisperse octahedral silver bromide emulsion of average grain size approximately 1.8 μm prepared by double-jet accelerated flow runs under controlled pAg conditions at 71° C. and in the presence of the thioether 1,10-dithia-4,7,13,16-tetraoxacyclooctadecane. The final gelatin content was 60 g/Ag mole. FIG. 5 is a carbon replica electron micrograph of Emulsion 1A.

Emulsion 1B: Edge-Selective AgSCN Epitaxial Growth

Figure 6:
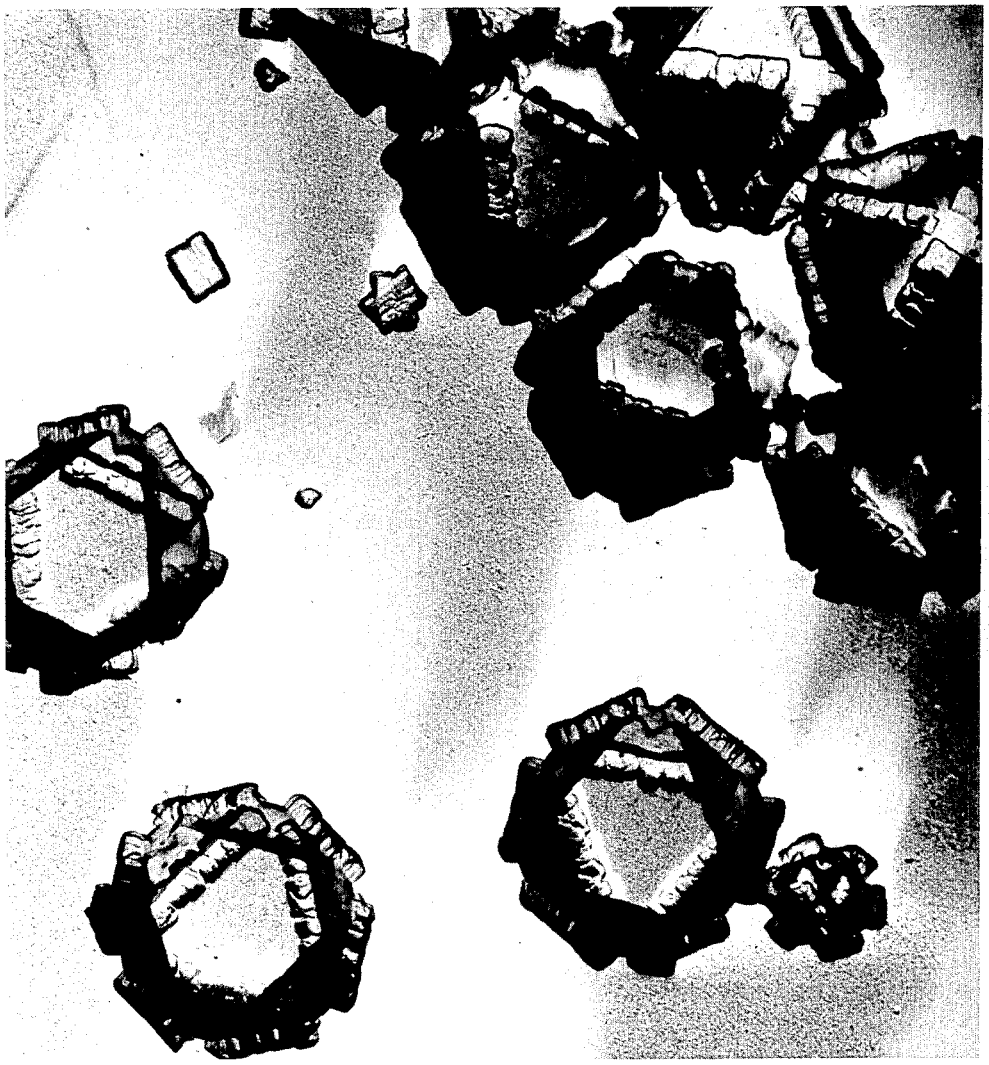

A 0.2 mole portion of the host emulsion 1A was diluted to 350 g. The pAg was adjusted to 7.5 at 40° C. by the slow addition of 1 M $AgNO_3$ solution. Then onto the emulsion was precipitated 10 mole percent AgSCN by double-jet addition of 1 M $AgNO_3$ and 1 M NaSCN solutions over a period of 10 minutes while maintaining the pAg at 7.5 at 40° C. FIG. 6 is an electron micrograph showing the edge-selective epitaxial deposition of AgSCN.

EXAMPLE 2

Example 2 illustrates edge-selective epitaxial deposition of 25 mole percent silver thiocyanate onto an octahedral and a cubic AgBr emulsion, resulting in increased sensitometric speed for the epitaxially-grown emulsions over their corresponding host emulsions.

Emulsion 2A: Host Octahedral Silver Bromide Emulsion

Figure 7:
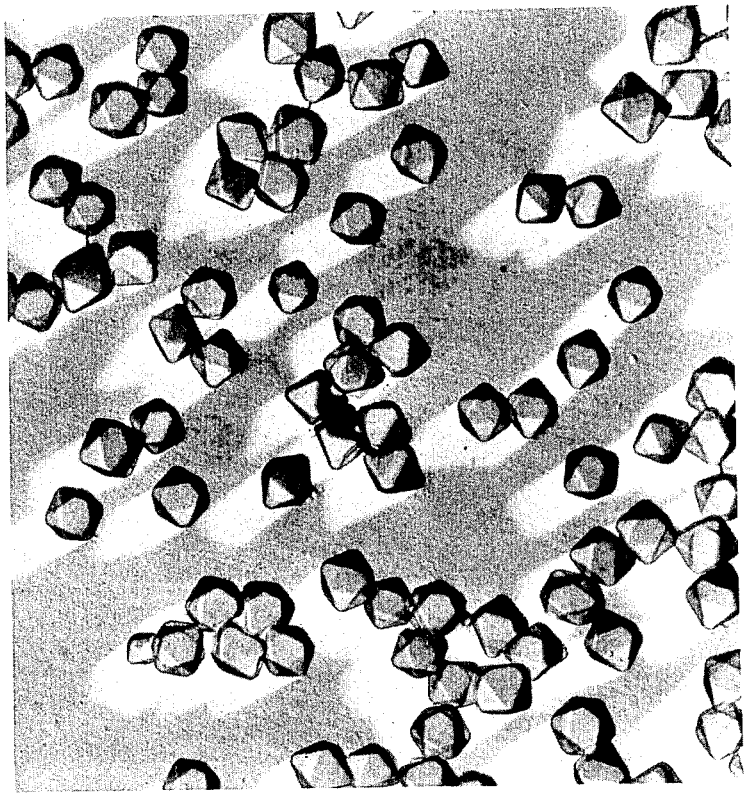

The octahedral host emulsion for Example 2 was a monodisperse silver bromide emulsion of average grain size approximately 0.6 μm, prepared by double-jet accelerated flow runs under controlled pAg conditions at 85° C. The final gelatin content was 40 g/Ag mole. An electron micrograph is shown in FIG. 7.

Emulsion 2B: Host Cubic Silver Bromide Emulsion

Figure 8:
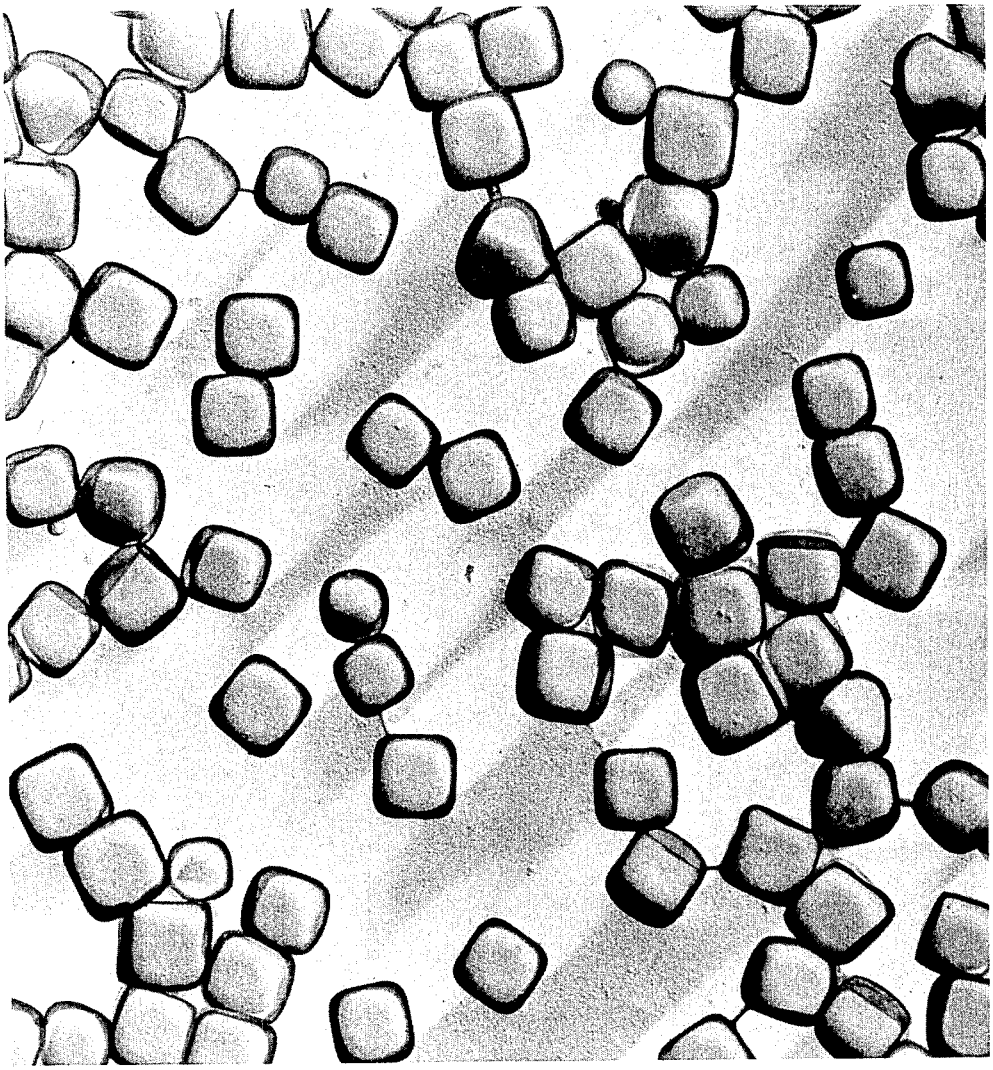

The cubic host emulsion for Example 2 was a monodisperse silver bromide emulsion of average grain size approximately 0.7 μm, prepared by double-jet accelerated flow runs under controlled pAg conditions at 65° C. and in the presence of the thioether 1,10-dithia-4,7,13,16-tetraoxacyclooctadecane. The final gelatin content was 40 g/Ag mole. An electron micrograph is shown in FIG. 8.

Emulsion 2C: Edge-Selective AgSCN Epitaxial Growth on Octahedral AgBr Host

Figure 9:
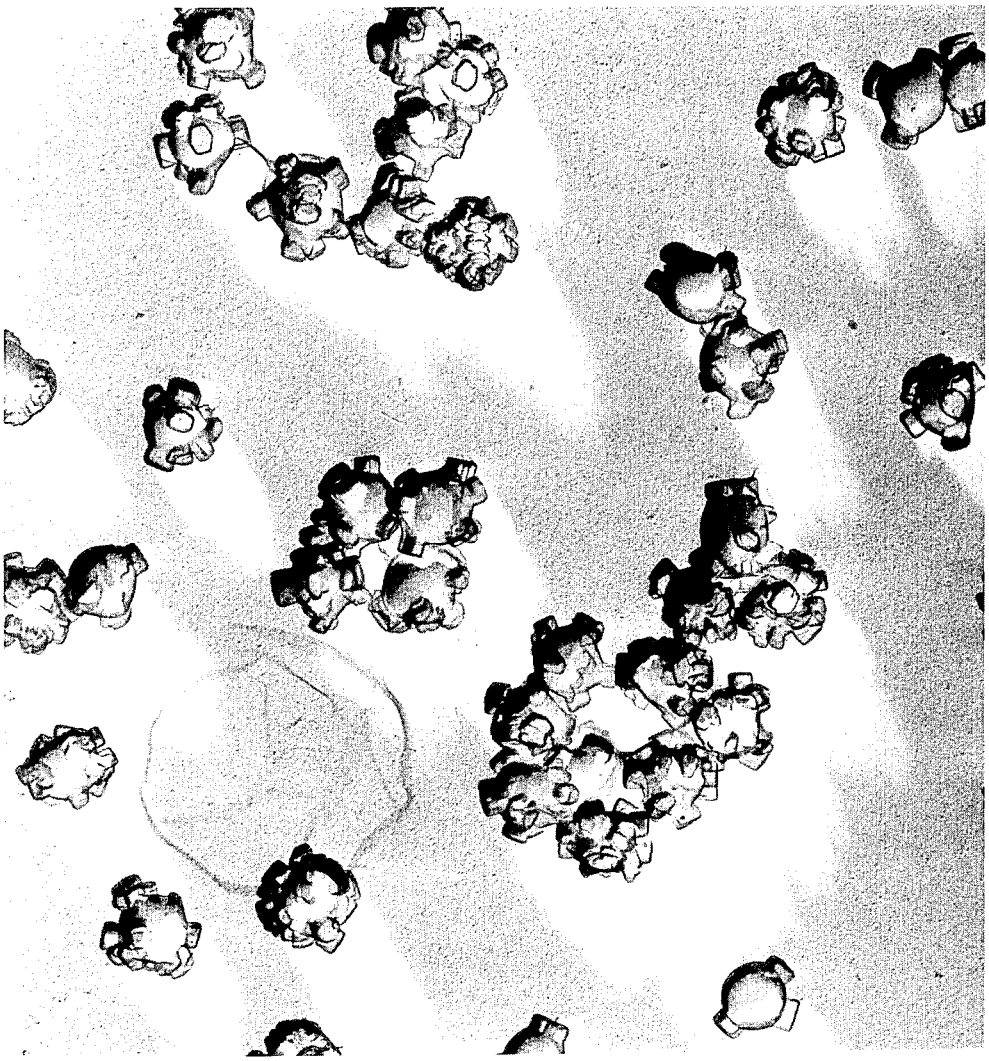

A 0.4 mole portion of the host Emulsion 2A was diluted to 400 g. The pAg was adjusted to 7.5 at 40° C. Then onto the emulsion was precipitated 25 mole percent AgSCN by double-jet addition of 2 M $AgNO_3$ and 2 M NaSCN solutions over a period of 20 minutes while maintaining the pAg at 7.5 at 40° C. FIG. 9 is an electron micrograph showing the predominantly edge-selective epitaxial deposition of AgSCN.

Emulsion 2D: Edge-Selective AgSCN Epitaxial Growth on Cubic AgBr Host

Figure 10:
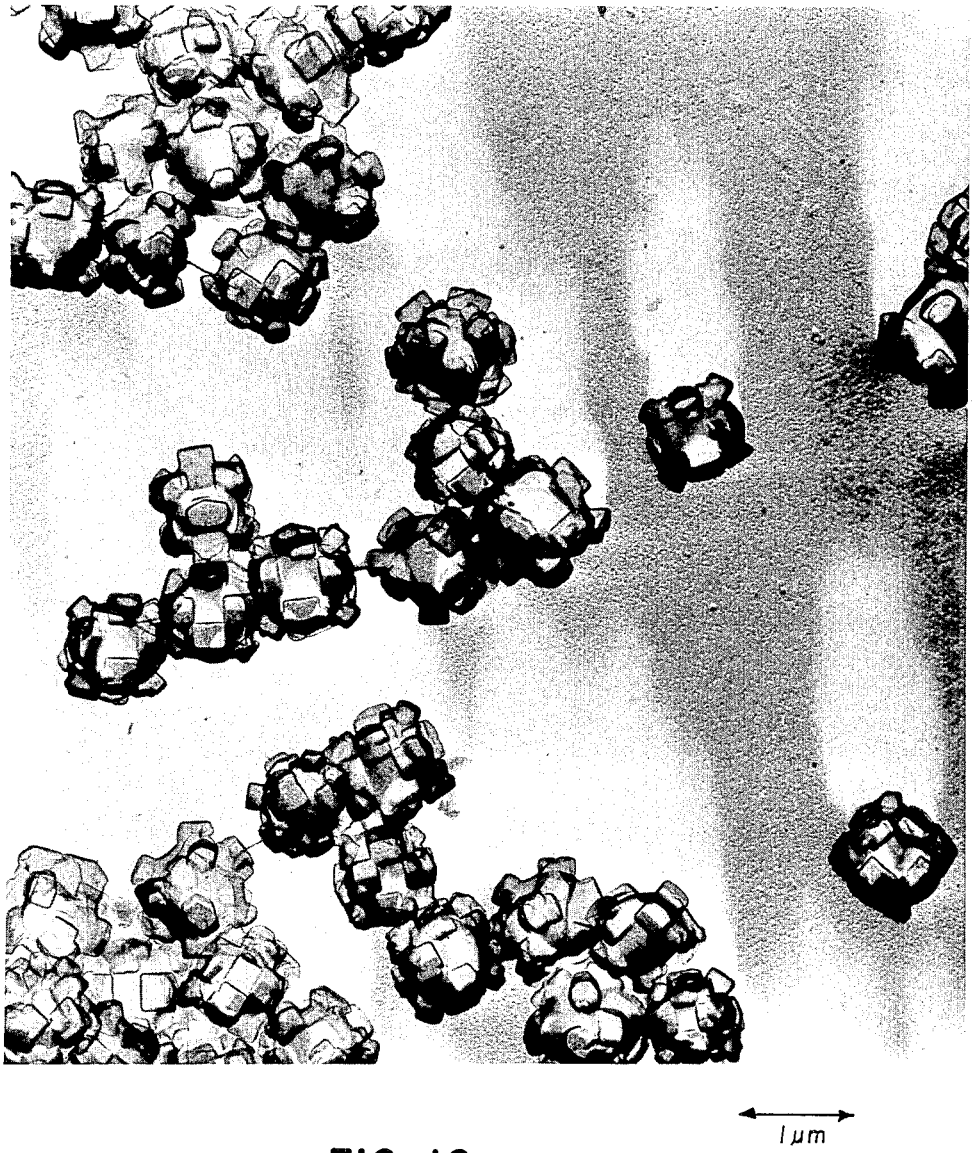

Emulsion 2D was prepared identically to Emulsion 2C, except that the cubic AgBr emulsion 2B was used as the host emulsion. FIG. 10 is an electron micrograph showing the predominantly edge-selective epitaxial deposition of AgSCN.

EXAMPLE 2

COATINGS

The following coatings of the emulsions of Example 2 were made on cellulose acetate support at 1.1 g/m$^2$ Ag and 3.7 g/m$^2$ gelatin. The coatings were exposed for ½ second to a 500 W, 2850° K. tungsten light source (Eastman 1B Sensitometer) through a graded density tablet and processed for 6 minutes using at 20° C. a hydroquinone-N-methyl-p-aminophenol sulfate developer containing 0.5 g/l KI. Speed values were determined at 0.3 density units above fog, and are given as Log Speed, 100 (1-LogE).

Coating 1: Host Octahedral Emulsion

A coating of Emulsion 2A.

Coating 2: Host Cubic Emulsion

A coating of Emulsion 2B.

Coating 3: AgSCN Epitaxial Growth on Octahedral Host

A coating of Emulsion 2C.

Coating 4: AgSCN Epitaxial Growth on Cubic Host

A coating of Emulsion 2D.

EXAMPLE 2

COATING RESULTS

| Coating No. | Log Speed | Gamma | Fog | Dmax |
|---|---|---|---|---|
| 1 | 41 | 0.88 | 0.04 | 0.66 |
| 2 | 81 | 0.55 | 0.04 | 0.46 |
| 3 | 96 | 0.94 | 0.03 | 0.66 |
| 4 | 115 | 0.72 | 0.05 | 0.51 |

The epitaxially grown emulsions 2C and 2D show greatly increased speed over their respective host emulsions 2A and 2B, without loss of gamma and Dmax or significant gain in fog.

EXAMPLE 3

Example 3 illustrates edge-selective epitaxial deposition of 5 mole percent silver thiocyanate onto a cubic AgCl emulsion.

Emulsion 3A: Host Cubic Silver Chloride Emulsion

Figure 11:
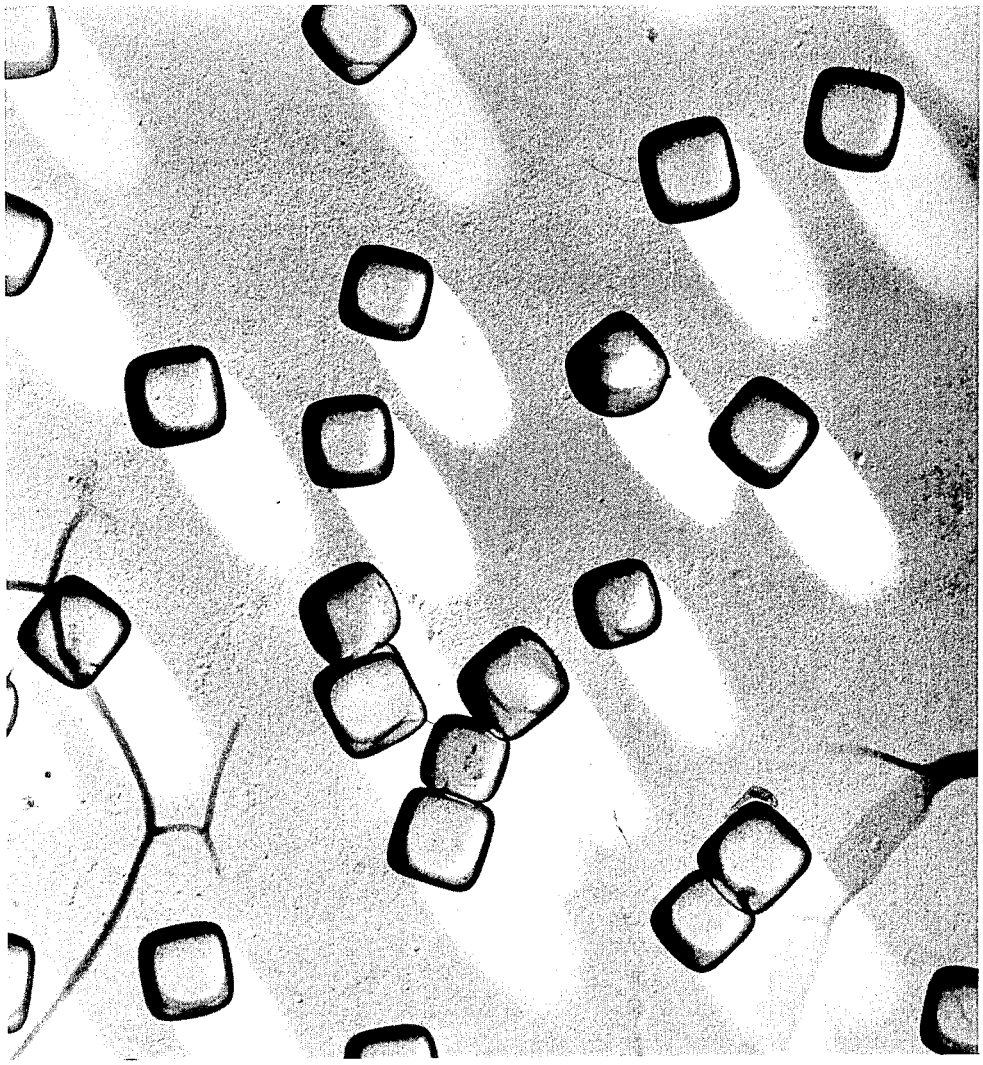

The host emulsion for Example 3 was a monodisperse cubic silver chloride emulsion of average grain size approximately 0.8 μm, prepared by double-jet runs under controlled pAg conditions at 60° C. and in the presence of the thioether 1,8-dihydroxy-3,6-dithiaoctane. The final gelatin content was 40 g/Ag mole. FIG. 11 is an electron micrograph of Emulsion 3A.

Emulsion 3B: Edge-Selective 5 percent AgSCN Epitaxial Growth

Figure 12:
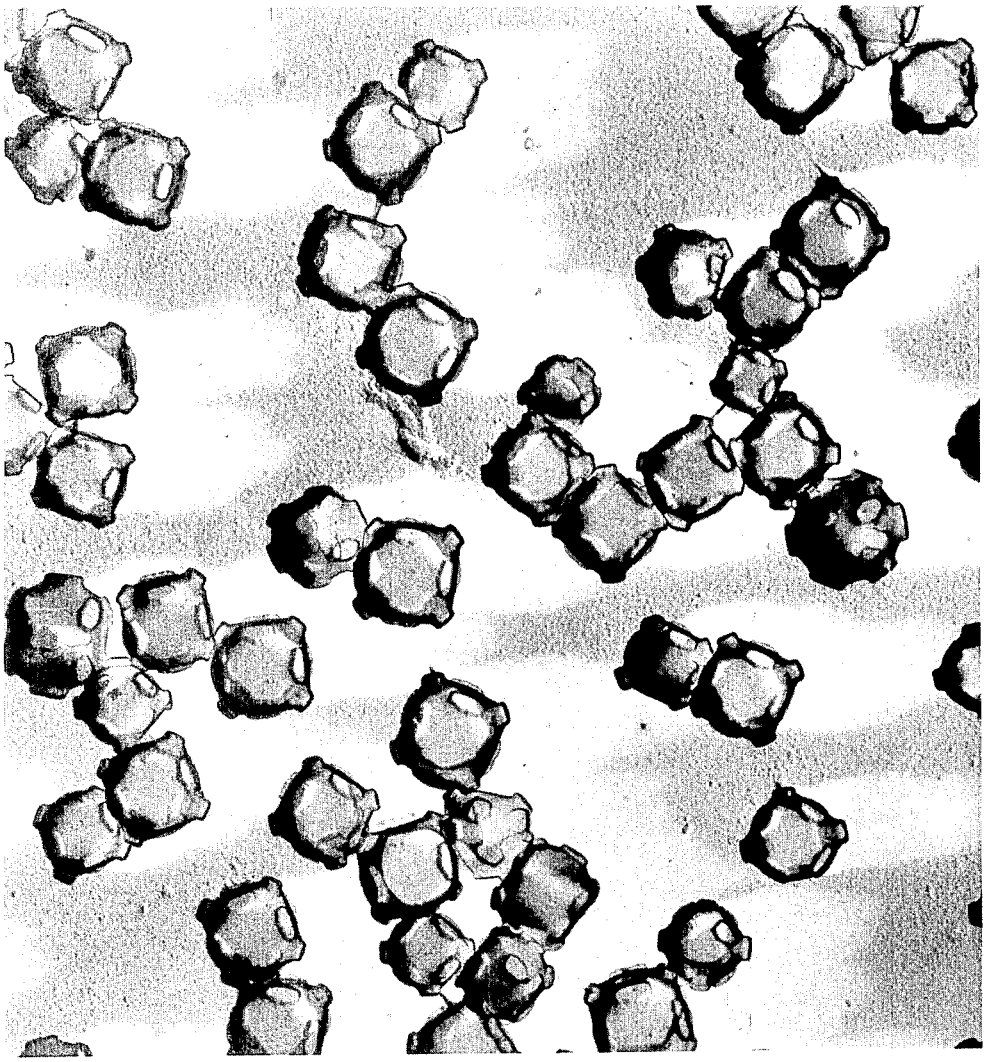

A 0.4 mole portion of the host emulsion 3A was diluted to 400 g. The pAg was adjusted to 7.5 at 40° C. Then onto the emulsion was precipitated 5 mole percent AgSCN by double-jet addition of 2 M $AgNO_3$ and 2 M NaSCN solutions over a period of 4 minutes while maintaining the pAg at 75 at 40° C. FIG. 12 is an electron micrograph showing the predominantly edge-selective epitaxial deposition of AgSCN.

EXAMPLE 4

Example 4 illustrates edge-selective epitaxial deposition of 25 mole percent silver thiocyanate onto a cubic AgCl emulsion. Increased sensitometric speed for the epitaxially-grown emulsion results, whether the host emulsion is not chemically sensitized or is gold sensitized prior to the epitaxial growth.

Emulsion 4A: Host Cubic Silver Chloride Emulsion

The host emulsion for Example 4 was Emulsion 3A of the previous example.

Emulsion 4B: Edge-Selective 25 Percent AgSCN Epitaxial Growth

Figure 13:
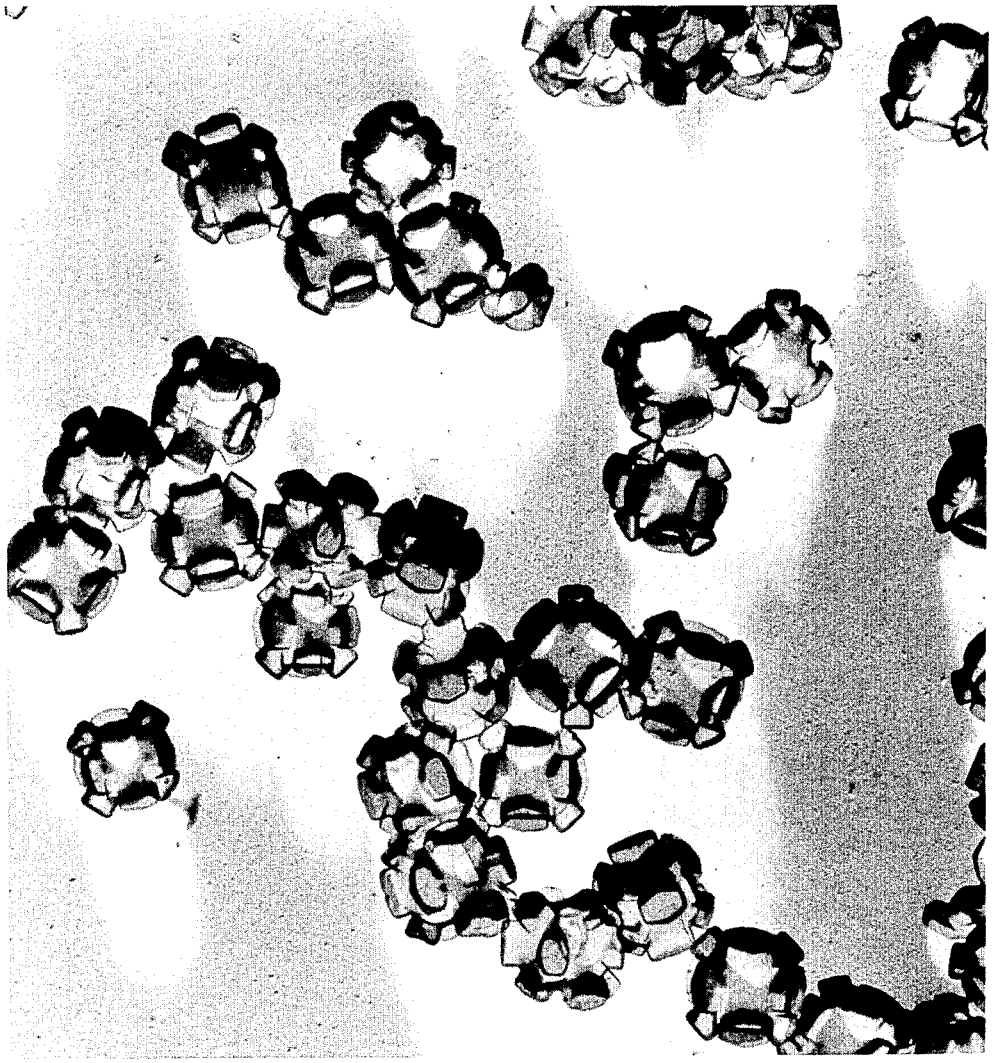

A 0.4 mole portion of the host emulsion 4A was diluted to 400 g. The pAg was adjusted to 7.5 at 40° C. Then onto the emulsion was precipitated 25 mole percent AgSCN by double-jet addition of 2 M $AgNO_3$ and 2 M NaSCN solutions over a period of 20 minutes while maintaining the pAg at 7.5 at 40° C. FIG. 13 is an electron micrograph showing the edge-selective epitaxial deposition of AgSCN.

Emulsion 4C: Gold-Sensitized Host Emulsion

A portion of host emulsion 4A was gold-sensitized by heating for 30 minutes at 60° C. with 2.5 mg/Ag mole of colloidal gold sulfide ($Au_2S$).

Figure 14:
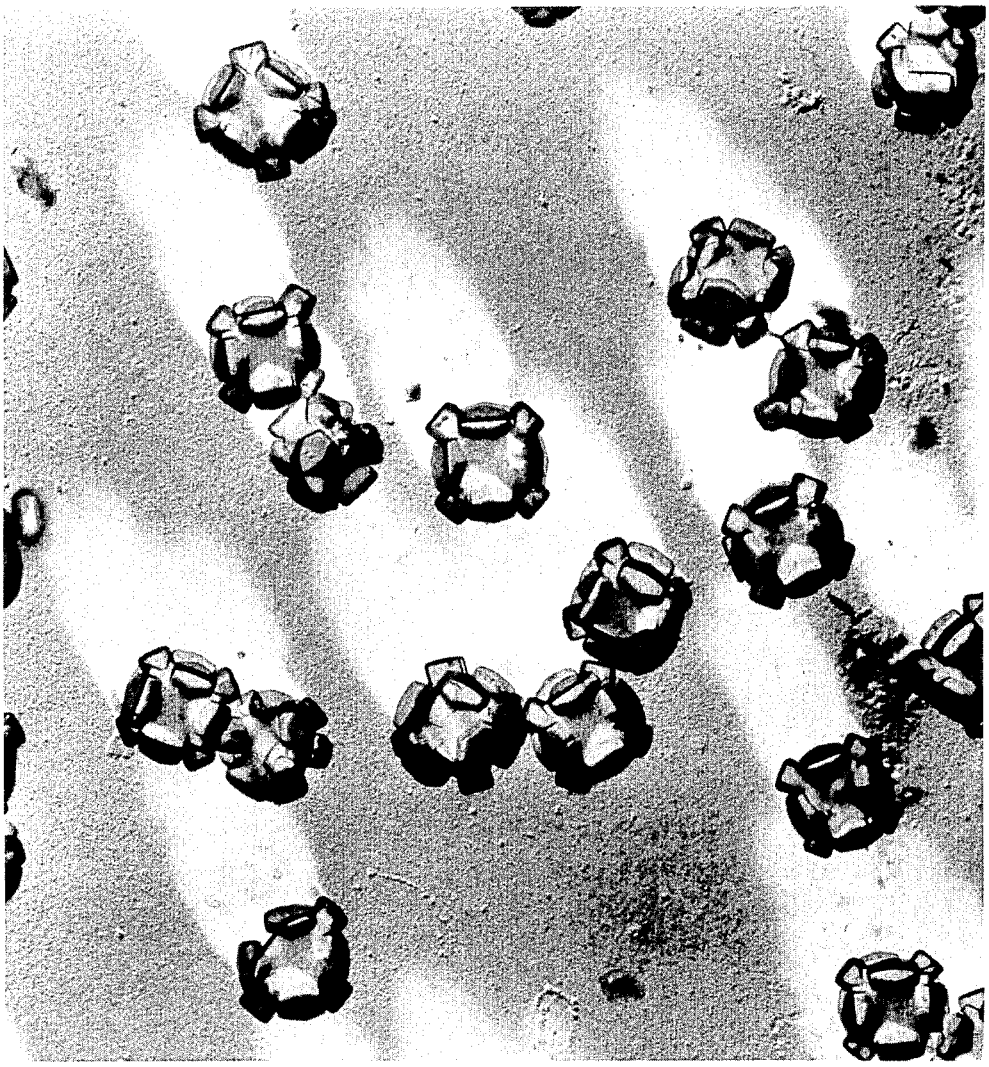

Emulsion 4D: Edge-Selective 25 Percent AgSCN Epitaxial Growth on Gold-Sensitized Host Emulsion 4D was prepared exactly as Emulsion 4B but using Emulsion 4C as the host in place of Emulsion 4A. FIG. 14 is an electron micrograph of Emulsion 4D showing edge-selective epitaxial deposition of AgSCN as in Emulsion 4B.

EXAMPLE 4

COATINGS

The following coatings of the emulsions of Example 4 were made on cellulose acetate support at 2.2 g/m$^2$ Ag and 3.6 g/m$^2$ gelatin. The emulsions were adjusted to pAg 7.5 with NaCl solution prior to coating. The coatings were exposed to a 500 W, 3000° K. tungsten light source (Eastman 1B Sensitometer) through a graded density tablet and processed for 6 minutes using at 20° C. a hydroquinone-N-methyl-p-aminophenol sulfate developer. Speed values were determined at 0.3 density units above fog, and are given as Log Speed, 100 (1−LogE).

Coating 1: Host AgCl Cubic Emulsion

A coating of Emulsion 4A.

Coating 2: AgSCN Epitaxial Growth On AgCl Cubic Host

A coating of Emulsion 4B.

Coating 3: Gold-Sensitized Host Emulsion

A coating of Emulsion 4C.

Coating 4: AgSCN Epitaxial Growth on Gold-Sensitized Host

A coating of Emulsion 4D.

EXAMPLE 4

COATING RESULTS

| Coating No. | Log Speed | Gamma | Fog | Dmax |
|---|---|---|---|---|
| 1 | −4 | 1.48 | 0.06 | 1.12 |
| 2 | 30 | 1.63 | 0.06 | 1.21 |
| 3 | 67 | 1.44 | 0.09 | 1.18 |
| 4 | 84 | 1.40 | 0.06 | 1.26 |

The epitaxially grown emulsion 4B (Coating 2) showed greatly increased speed over its non-chemically sensitized host 4A (Coating 1). Gold sensitization of the host 4C (Coating 3) caused a large speed increase over the unsensitized host 4A (Coating 1). Subsequent epitaxial growth of AgSCN on the sensitized host to produce Emulsion 4D caused a further speed increase (Coating 4).

EXAMPLE 5

Example 5 illustrates the selective-site epitaxial growth of silver cyanide on a cubic AgCl host emulsion.

Emulsion 5A: Host Cubic Silver Chloride Emulsion

Figure 15:
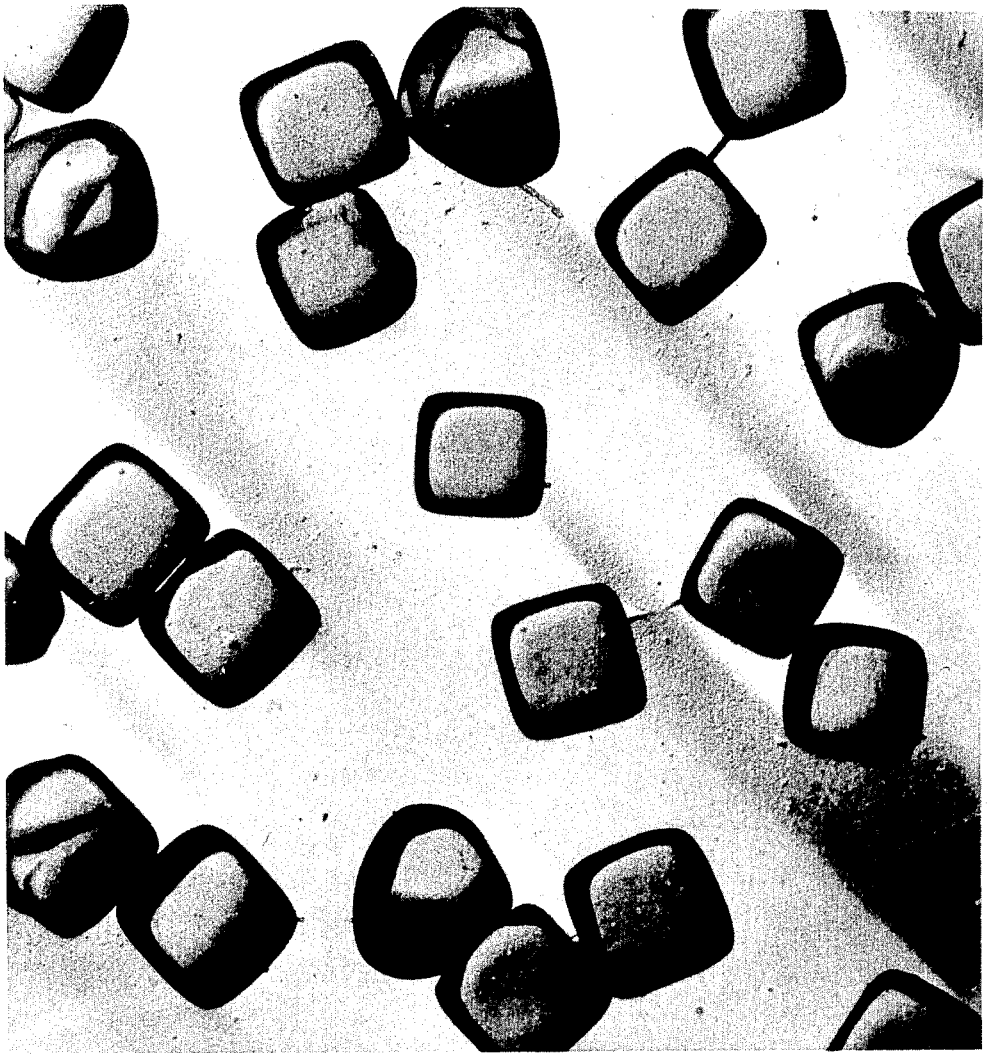

The host emulsion for Example 5 was a monodisperse silver chloride emulsion of average grain size approximately 1.2 μm, prepared by double-jet accelerated flow runs under controlled pAg conditions at 40° C. The emulsion as precipitated contained 8.3 g/Ag mole of deionized bone gelatin. When precipitation was complete, the emulsion was centrifuged, and the precipitate resuspended in 0.33 L/Ag mole of 3.7 percent deionized bone gelatin. The pAg was adjusted to 7.5 at 40° C. before storage. FIG. 15 is an electron micrograph of Emulsion 5A.

Figure 16:
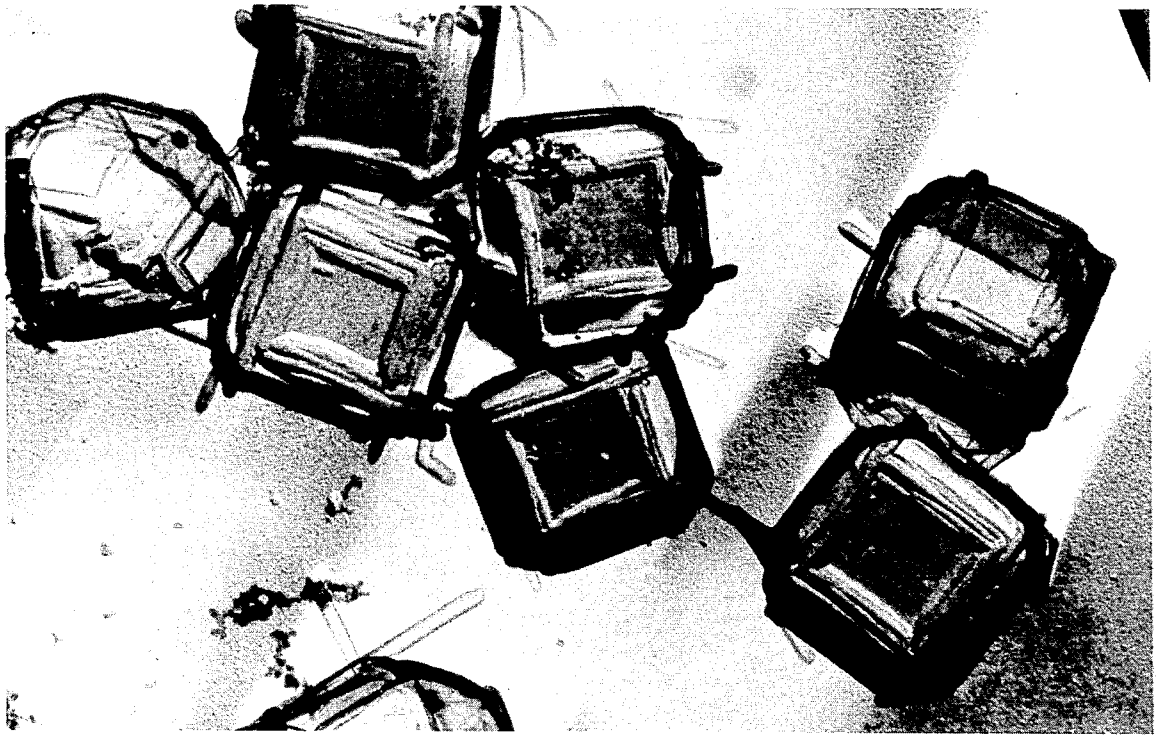

Emulsion 5B: Selective-Site AgCN Epitaxial Deposition Parallel to the Edges of the AgCl Host Emulsion A 0.4 mole portion of the host emulsion 5A was diluted to 350 g., including an additional 7 g. of deionized bone gelatin. The pAg was adjusted to 6.4 by the slow addition of 2 M $AgNO_3$ solution. Then onto the emulsion was precipitated 5 mole percent of AgCN by double-jet addition of 2 M $AgNO_3$ and 2 M NaCN solutions over a period of 4.2 minutes while maintaining the pAg at 6.4 at 40° C. At the completion of the precipitation the pAg was adjusted to 7.5 at 40° C. by the addition of NaCl solution. FIG. 16 is an electron micrograph of Emulsion 5B showing the linear epitaxial deposition of AgCN parallel to the edges of the cubic host grains.

EXAMPLE 6

Example 6 illustrates the edge-selective epitaxial growth of silver thiocyanate on a cubic AgCl host emulsion followed by the growth of a further shell of silver chloride.

Emulsion 6A: Host Cubic Silver Chloride Emulsion

The host emulsion for Example 6 was Emulsion 3A of Example 3.

Emulsion 6B: Edge-Selective 5 Percent AgSCN Epitaxial Growth

Figure 17:
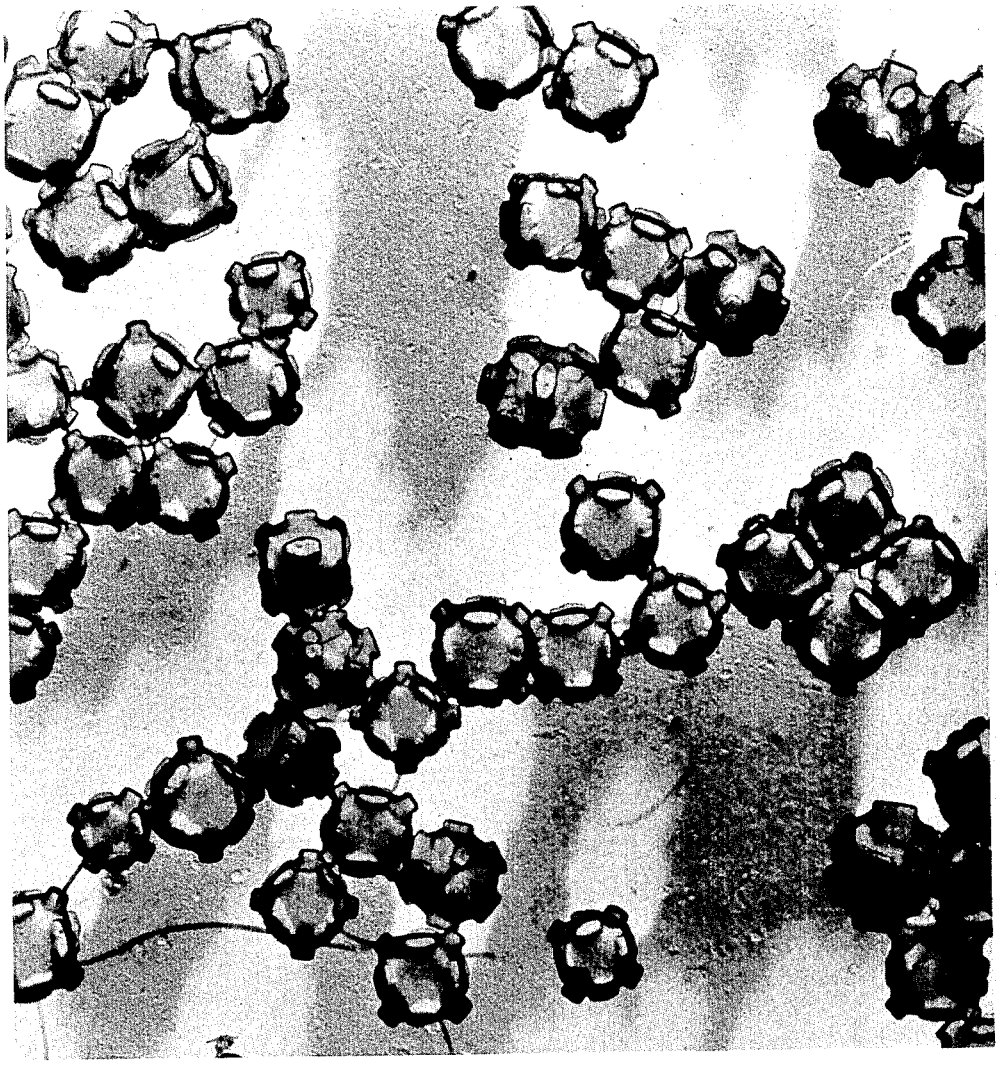

A 0.2 M portion of Emulsion 6A was diluted to 400 g. The pAg was adjusted to 7.5 at 40° C. by the addition of NaCl solution. Then onto the emulsion was precipitated 5 mole percent AgSCN by double-jet addition of 1 M $AgNO_3$ and 1 M NaSCN solution over a period of 4.3 minutes while maintaining the pAg at 7.5 at 40° C. FIG. 17 is an electron micrograph showing the edge-selective epitaxial deposition of AgSCN.

Emulsions 6C, 6D, 6E: Shelling of Epitaxially Grown Crystals with AgCl

Figure 18:
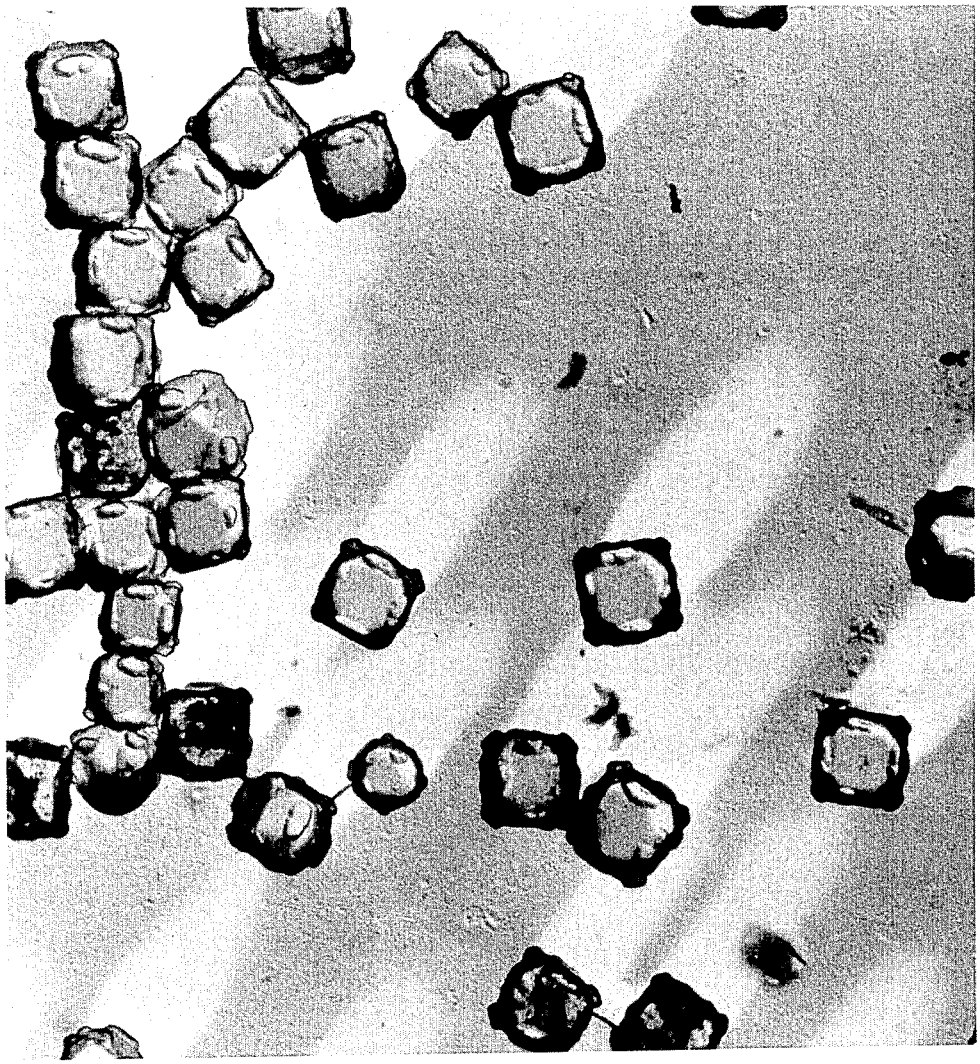
Figure 19:
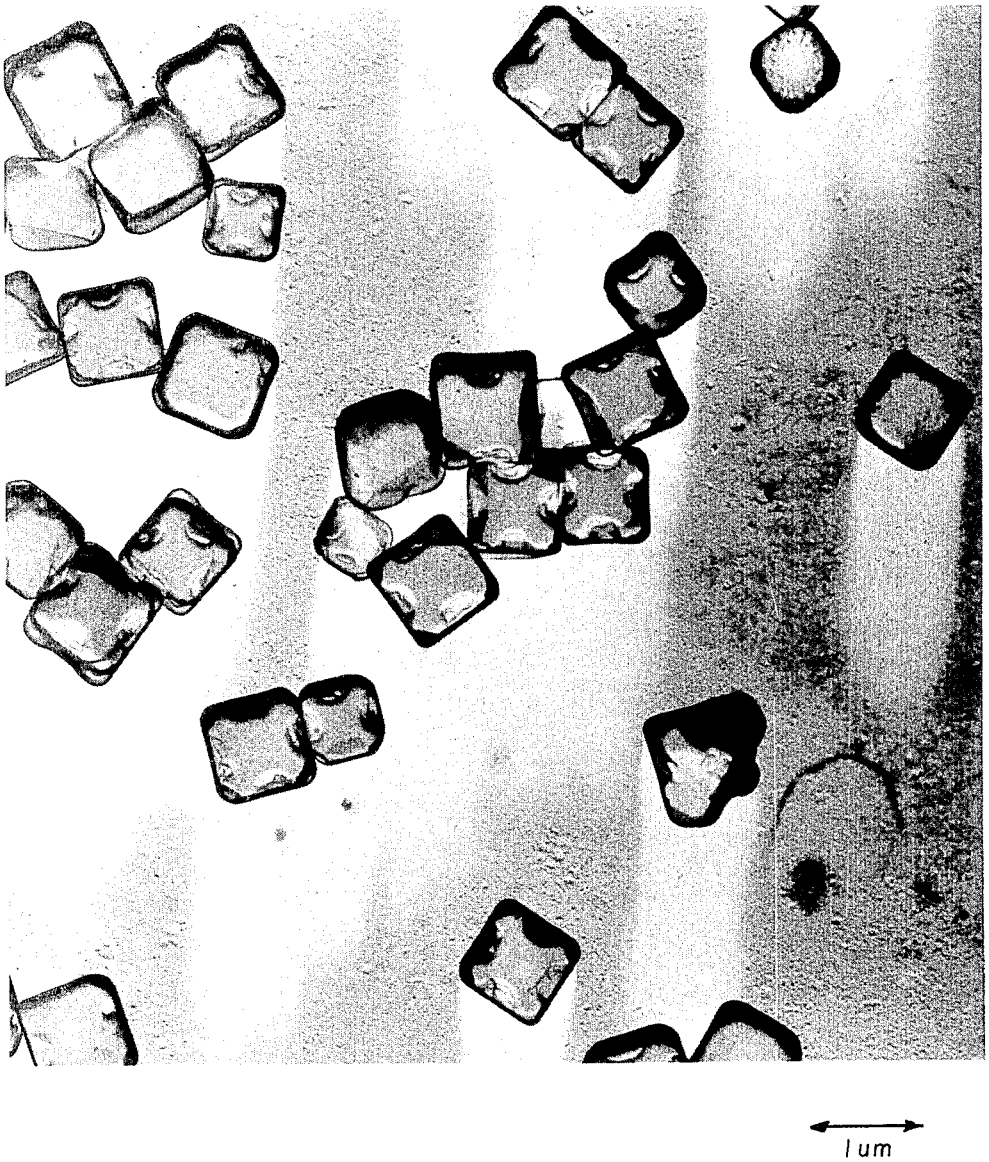
Figure 20:
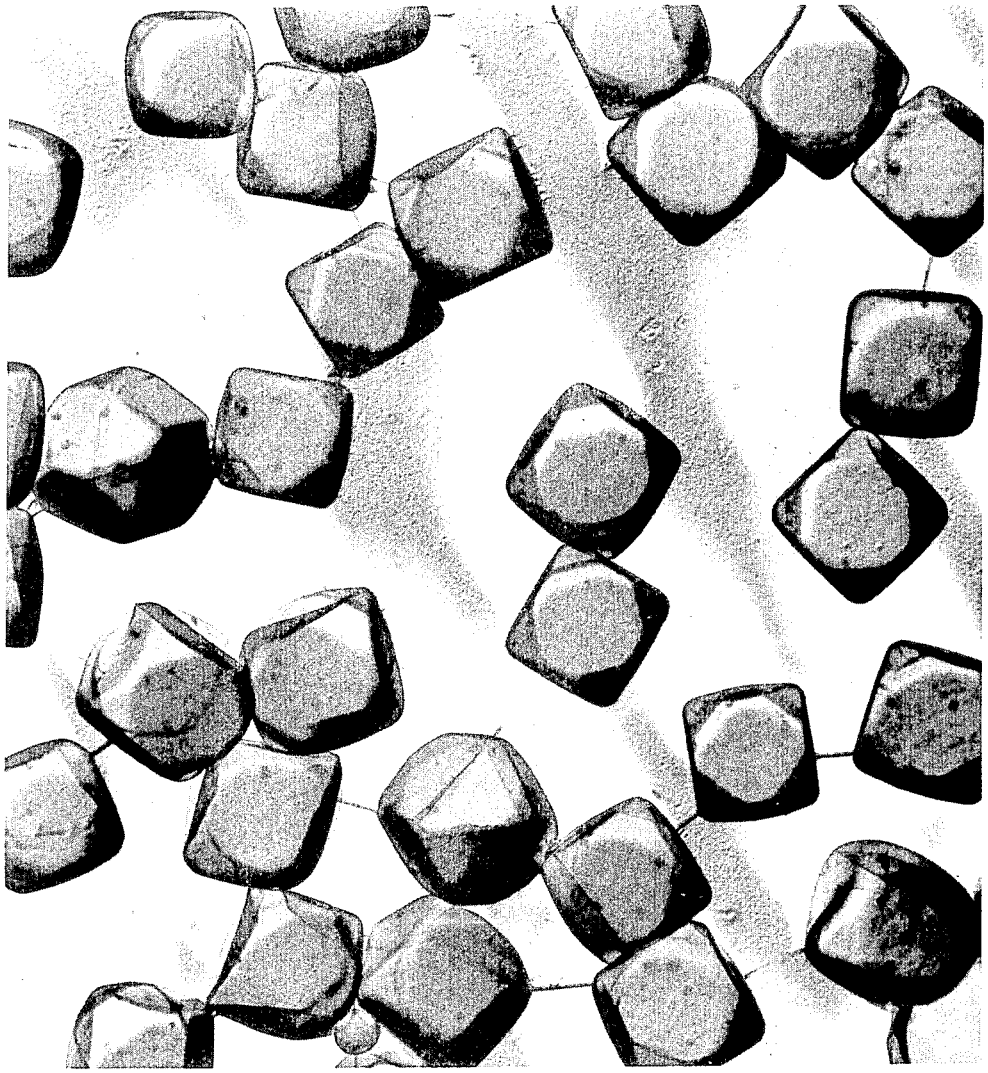

The pAg of epitaxially-grown Emulsion 6B was adjusted to 8.0 at 40° C. with NaCl solution. Then onto the emulsion was precipitated 2 mole percent AgCl (based on the moles of AgCl host emulsion) by the double-jet addition of 4 M $AgNO_3$ and 4.12 M NaCl solutions over a period of 10 minutes, while maintaining the pAg at 8.0 at 40° C. Addition was then continued at pAg 8.0 at 40° C., using accelerated flow (32×from start to finish) over an additional period of 108 minutes. Samples were taken for electron micrographs when 17.6 mole percent AgCl was deposited (Emulsion 6C, FIG. 18); 84.4 mole percent AgCl (Emulsion 6D, FIG. 19); and finally 364 mole percent AgCl (Emulsion 6E, FIG. 20). The figures show the gradual shelling of the epitaxially grown Emulsion 6B by the additional AgCl.

EXAMPLE 7

Example 7 illustrates selective-site epitaxial growth of silver thiocyanate on a cubic AgCl host emulsion, followed by the selective-site epitaxial growth of silver cyanide.

Example 7A: Host Cubic Silver Chloride Emulsion

Figure 21:
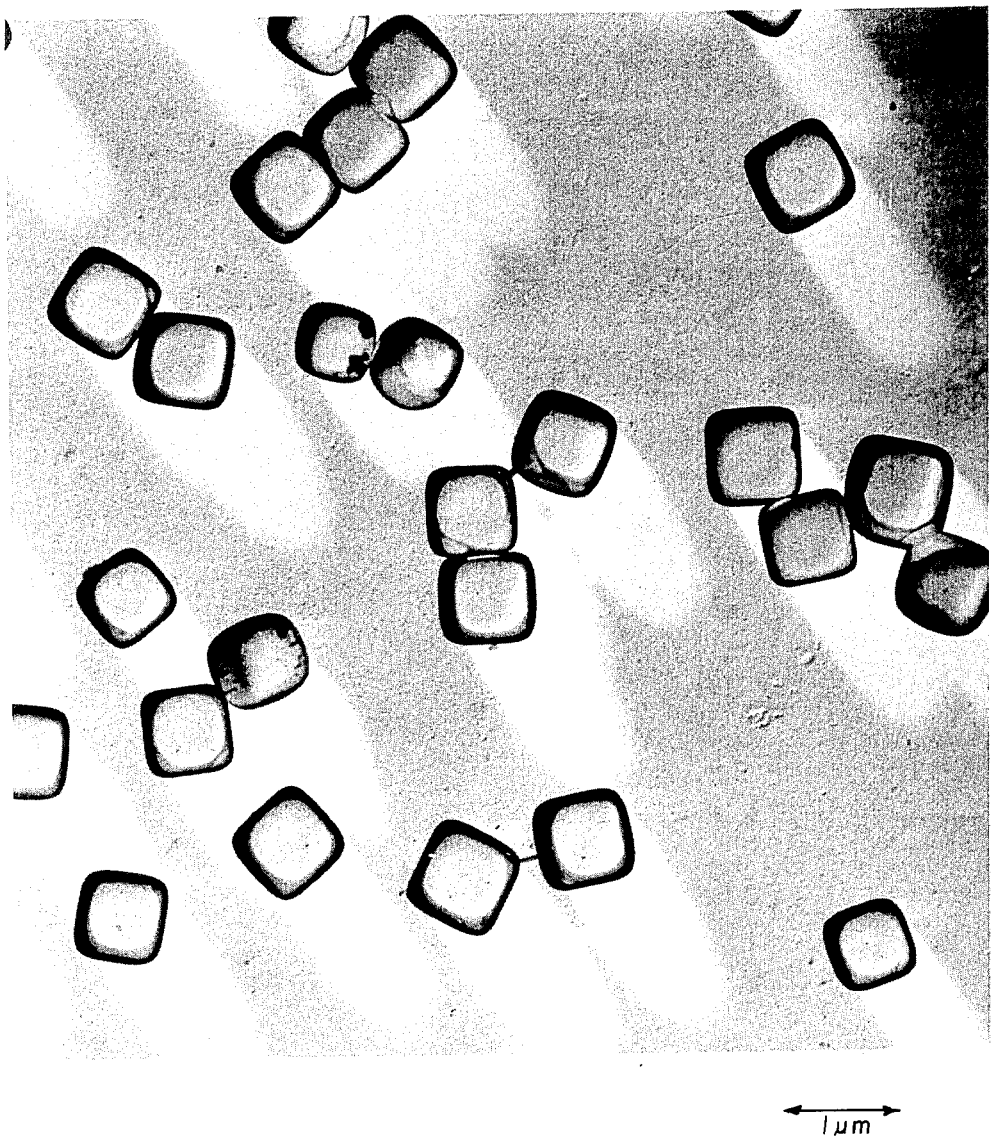

The host emulsion for Example 7 was a monodisperse cubic silver chloride emulsion of average grain size approximately 0.75 μm, prepared as described for Emulsion 3A. An electron micrograph of Emulsion 7A is shown in FIG. 21.

Emulsion 7B: Site-Selective Epitaxial Growth of AgSCN, then AgCN

Figure 22:
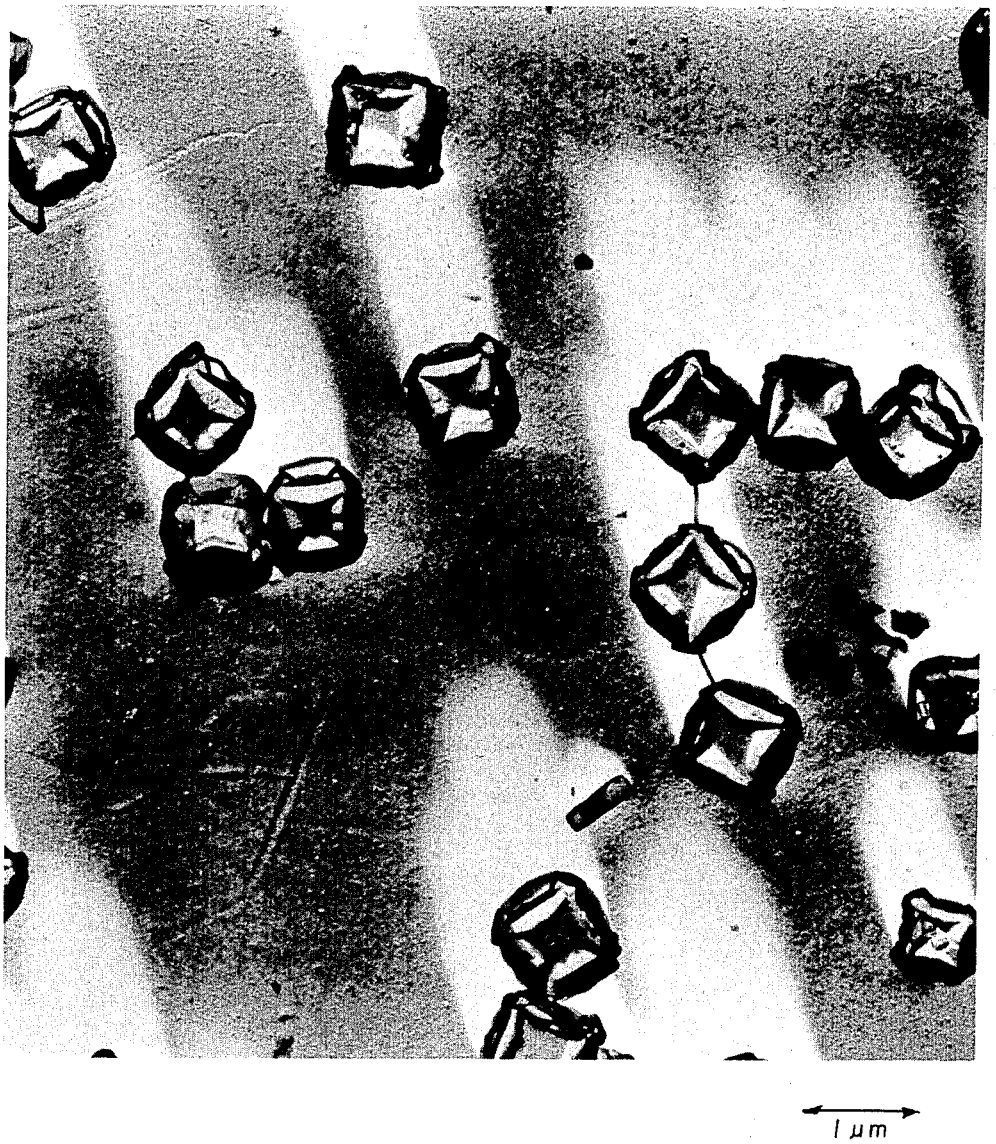
Figure 23:
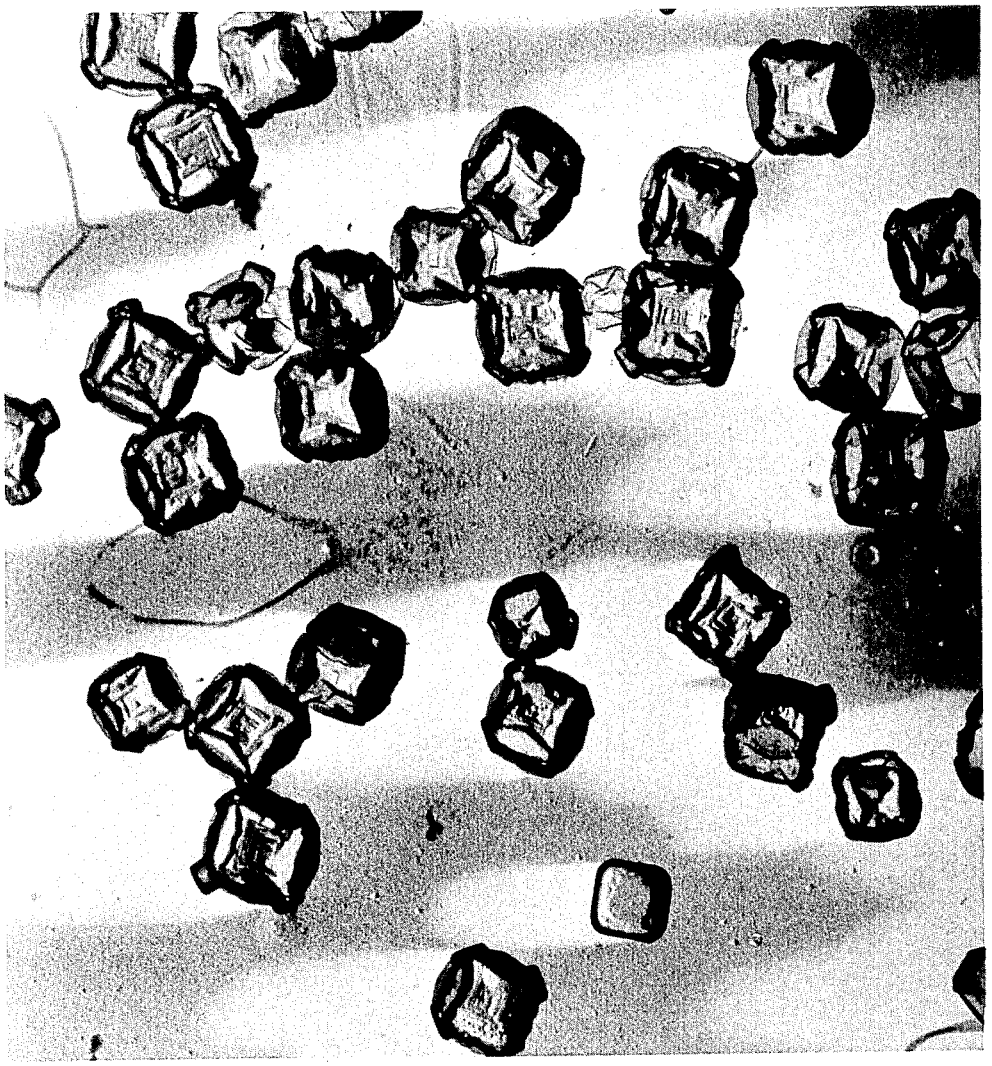

A 0.4 M sample of Emulsion 7A was diluted to 350 g., and the pAg adjusted to 6.4 by the slow addition of 2 M $AgNO_3$ solution. Then onto the emulsion was precipitated 25 mole percent of AgSCN by double-jet addition of 2 M $AgNO_3$ and 2 M NaSCN solutions over a period of 14 minutes while maintaining the pAg at 6.4 at 40° C. FIG. 22 is an electron micrograph showing the edge-selective epitaxial deposition of AgSCN. Then 5 mole percent of AgCN (based on the moles of host AgCl emulsion) was precipitated by the double-jet addition of 2 M $AgNO_3$ and 2 M NaCN solutions over a period of 3 minutes, while maintaining pAg 6.4 at 40° C. The pAg was then adjusted to 7.5 by addition of NaCl solution. FIG. 23 is an electron micrograph showing the combined edge-selective epitaxial deposition of AgSCN and the linear deposition of AgCN parallel to the edges.

EXAMPLE 8

This example illustates the controlled site epitaxially deposition of AgSCN onto the tabular grains of a silver bromoiodide emulsion.

Emulsion 8A: Tabular Grain AgBrI (6 mole Percent iodide) Host

To 6.0 liters of a 1.5 percent gelatin solution containing 0.12 M potassium bromide at 55° C. were added with stirring and by double-jet, a 2.0 molar KBr solution containing 0.12 molar KI and a 2.0 molar $AgNO_3$ solution over an eight minute period while maintaining the pBr of 0.92 (consuming 5.3 percent of the total silver used). The bromide and silver solutions were then run concurrently maintaining pBr 0.92 in an accelerated flow (6.0×from start to finish—i.e., six times faster at the end than at the start) over 41 minutes (consuming 94.7 percent of the total silver used). A total of 3.0 moles of silver was used. The emulsion was cooled to 35° C., washed by the coagulation method of U.S. Pat. No. 2,614,929 of Yutzy and Russell, and stored at pAg 7.6 measured at 40° C. The resultant tabular grain AgBrI (6 mole percent iodide) emulsion had an average grain diameter of 3.0 μm, an average thickness of 0.09 μm, an average aspect ratio of 33:1, and 85 percent of the grains were tabular based on projected area.

Emulsion 8B: Edge Selective AgSCN Epitaxial Growth 40 g of the tabular grain AgBrI (6 mole percent iodide) host Emulsion 8A (0.04 mole) was adjusted to pAg 7.2 at 40° C. by the simultaneous addition of 0.1 molar $AgNO_3$ and 0.006 molar KI. Then 1.0 ml of a 0.13 molar NaSCN solution was added. Then 5 mole percent AgSCN was precipitated into the host emulsion by double-jet addition for 16 minutes of 0.25 molar NaSCN and 0.25 molar $AgNO_3$ solutions while maintaining the pAg at 7.5 at 40° C.

Figure 24:
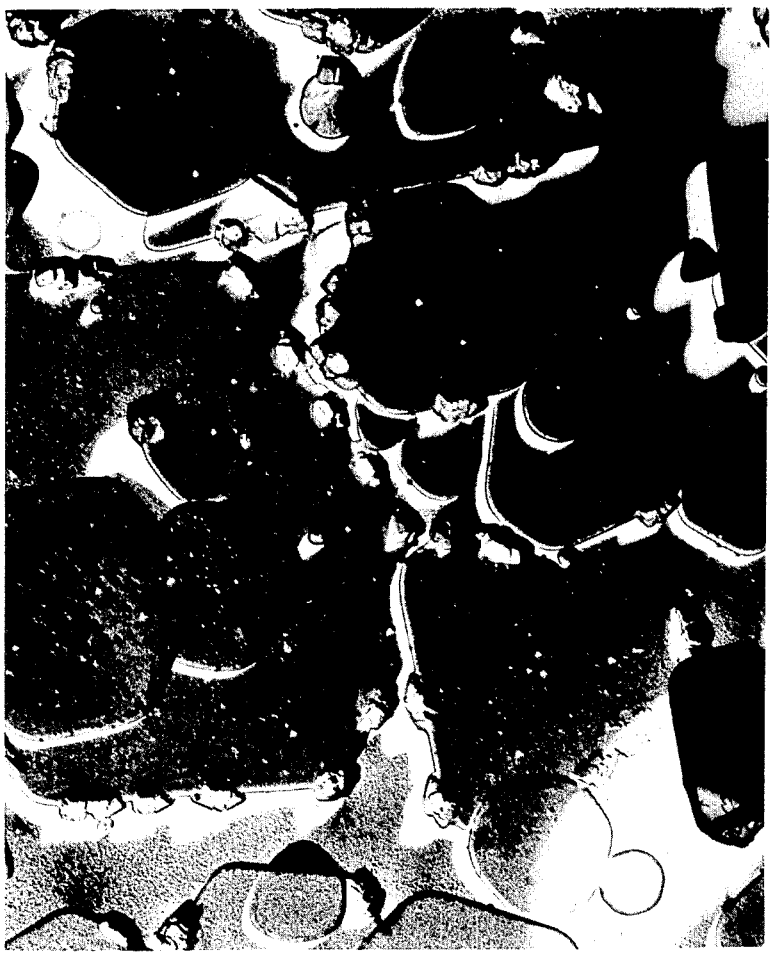

Electron micrographs of Emulsion 8B, which was not spectrally sensitized prior to the addition of the soluble silver and thiocyanate salts, resulted in epitaxial deposition of silver thiocyanate selectively at the edges of the tabular AgBrI grains. FIG. 24 is a representative electron micrograph of Emulsion 8B.

EXAMPLE 9

This example illustrates the epitaxial deposition of AgSCN on a tabular grain AgCl emulsion.

Control Emulsion 9A: Tabular Grain AgCl Host

To 2.0 liters of a 0.625 percent synthetic polymer, poly(3-thiapentylmethacrylate)-co-acrylic acid-co-2-methacryloyloxyethyl-1-sulfonic acid, sodium salt, (1:2:7) solution containing 0.35 percent ($2.6\times10^{-2}$ molar) adenine, 0.5 molar $CaCl_2$, and $1.25\times10^{-2}$ molar NaBr at pH 2.6 at 55° C. were added with stirring and by double-jet a 2.0 molar $CaCl_2$ solution and 2.0 molar $AgNO_3$ solution for 1 minute (consuming 0.08 percent of the total silver used). The chloride and silver solutions were then run concurrently at controlled pCl in an accelerated flow (2.3×from start to finish) over 15 minutes (consuming 28.8 percent of the total silver used). Then the chloride and silver solutions were run for an additional 26.4 minutes (consuming 71.1 percent of the total silver used). A 0.2 molar NaOH solution (30.0 ml) was added slowly during approximately the first one-third of the precipitation to maintain the pH at 2.6 at 55° C. A total of approximately 2.6 moles of silver was used. The emulsion was cooled to room temperature, dispersed in $1\times10^{-3}$ molar $HNO_3$, settled, and decanted. The solid phase was resuspended in a 3 percent gelatin solution and adjusted to pAg 7.5 at 40° C. with a NaCl solution. The resultant tabular grain AgCl emulsion had an average grain diameter of 4.3 μm, an average thickness of 0.28 μm, and an average aspect ratio of 15:1 and 80 percent of the grains were tabular based on total projected area.

Emulsion 9B: Edge Selective AgSCN Epitaxial Growth

Then 5 mole percent AgSCN was precipitated into 40 g of the tabular grain AgCl host Emulsion 9A (0.04 mole) prepared above by double-jet addition for 7.8 minutes of 0.5 molar NaSCN and 0.5 molar $AgNO_3$ solutions.

Figure 25:
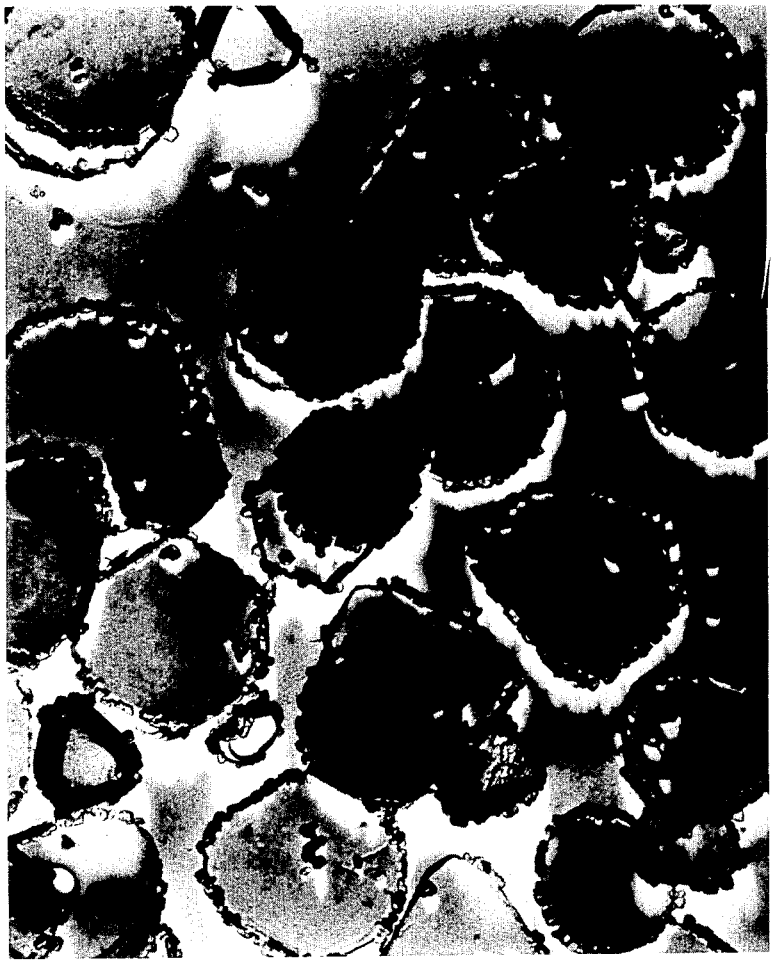

Electron micrographs of Emulsion 9B revealed that AgSCN was deposited almost exclusively at the edges of the AgCl tabular crystals. FIG. 25 is a representative electron micrograph of the emulsion. The AgCl tabular crystals contained both {110} and {111} edges, but AgSCN was deposited without preference at both types of edge sites.

The invention has been described in detail with particular reference to preferred embodiments thereof, but it will be understood that variations and modifications can be effected within the spirit and scope of the invention.

What is claimed is:

1. A radiation-sensitive emulsion comprised of
a dispersing medium,
silver halide host grains of a face centered cubic rock salt type crystal structure, and
nonisomorphic silver salt of areally limited epitaxial compatibility located on and substantially confined to at least one of edge and corner sites of said host grains.

2. A radiation-sensitive emulsion according to claim 1 wherein said host grains are bounded by {100} crystal faces.

3. A radiation-sensitive emulsion according to claim 1 wherein said host grains are bounded by {111} crystal faces.

4. A radiation-sensitive emulsion according to claim 1 wherein said host grains are comprised of chloride.

5. A radiation-sensitive emulsion according to claim 1 wherein said host grains are comprised of bromide.

6. A radiation-sensitive emulsion according to claim 5 wherein said host grains are additionally comprised of up to 40 mole percent iodide, based on total halide present in said host grains.

7. A radiation-sensitive emulsion according to claim 6 wherein said host grains are comprised of up to 15 mole percent iodide, based on total halide present in said host grains.

8. A radiation-sensitive emulsion according to claim 1 wherein said nonisomorphic silver salt exhibits an orthorhombic crystal structure.

9. A radiation-sensitive emulsion according to claim 1 wherein said nonisomorphic silver salt exhibits a monoclinic crystal structure.

10. A radiation-sensitive emulsion according to claim 1 wherein said nonisomorphic silver salt exhibits a hexagonal wurtzite type crystal structure.

11. A radiation-sensitive emulsion according to claim 1 wherein said nonisomorphic silver salt exhibits a body centered cubic zinc blende type structure.

12. A radiation-sensitive emulsion according to claim 1 wherein said nonisomorphic silver salt is epitaxially located on less than 50 percent of the surface area of said silver halide host grains.

13. A radiation-sensitive emulsion according to claim 12 wherein said nonisomorphic silver salt is epitaxially located on less than 25 percent of the surface area of said silver halide host grains.

14. A radiation-sensitive emulsion according to claim 13 wherein said nonisomorphic silver salt is epitaxially located on less than 10 mole percent of the surface area of said silver halide host grains.

15. A radiation-sensitive emulsion according to claim 1 wherein said nonisomorphic silver salt consists essentially of silver iodide.

16. A radiation-sensitive emulsion according to claim 1 wherein said nonisomorphic silver salt consists essentially of silver thiocyanate.

17. A radiation-sensitive emulsion according to claim 1 wherein said nonisomorphic silver salt consists essentially of silver cyanide.

18. A radiation-sensitive emulsion according to claim 1 wherein isomorphic silver halide is additionally located on said host grains.

19. A radiation-sensitive emulsion according to claim 18 wherein said additional isomorphic silver halide substantially shells said host grains.

20. A radiation-sensitive emulsion comprised of
a dispersing medium,
silver halide host grains of a face centered cubic rock salt type crystal structure comprised of bromide and exhibiting {111} crystal faces, and
nonisomorphic silver salt of areally limited epitaxial compatibility located on and substantially confined to at least one of edge and corner sites of said host grains, said silver salt being comprised of silver thiocyanate.

21. A radiation-sensitive emulsion according to claim 20 wherein said silver halide host grains are octahedral silver bromide grains and said nonisomorphic silver salt consists essentially of silver thiocyanate located along the edges of said host grains.

22. A radiation-sensitive emulsion comprised of
a dispersing medium,
silver halide host grains of a face centered cubic rock salt type crystal structure comprised of chloride and presenting {100} crystal faces, and nonisomorphic silver salt of areally limited epitaxial compatibility located on and substantially confined to at least one of edge and corner sites of said host grains, said nonisomorphic silver salt being comprised of thiocyanate.

23. A radiation-sensitive emulsion according to claim 22 wherein said host grains are cubic and said nonisomorphic silver salt consists essentially of silver thiocyanate located along the edges of said host grains.

24. A radiation-sensitive emulsion according to claim 23 wherein said silver thiocyanate and said host grains are shelled with additional silver halide.

25. A radiation-sensitive emulsion comprised of a dispersing medium, silver halide host grains of a face centered cubic rock salt type crystal structure comprised of chloride and bounded by {100} crystal faces, and nonisomorphic silver salt consisting essentially of silver cyanide located on and substantially confined to sites parallel to the edges of said silver halide host grains.

26. A radiation-sensitive emulsion according to claim 25 wherein an additional nonisomorphic silver salt consisting essentially of silver thiocyanate is additionally epitaxially located at selected sites on said host grains.

27. A photographic element comprised of a support and, located on said support, at least one radiation-sensitive emulsion according to any one of claims 1 through 26.

* * * * *